United States Patent [19]

Aida et al.

[11] Patent Number: 4,962,015

[45] Date of Patent: Oct. 9, 1990

[54] SILVER HALIDE PHOTOGRAPHIC MATERIAL

[75] Inventors: Shunichi Aida; Yoshinori Shibata, both of Kanagawa, Japan

[73] Assignee: Fuji Photo Film Co., Ltd., Kanagawa, Japan

[21] Appl. No.: 346,763

[22] Filed: May 2, 1989

[30] Foreign Application Priority Data

May 2, 1988 [JP] Japan ..... 63-109548

[51] Int. Cl.[5] ..... G03C 1/02

[52] U.S. Cl. ..... 430/572; 430/567; 430/569; 430/570; 430/603

[58] Field of Search ..... 430/567, 569, 570, 572, 430/603

[56] References Cited

U.S. PATENT DOCUMENTS

| | | | |
|---|---|---|---|
| 4,665,012 | 5/1987 | Sugimoto et al. | 430/502 |
| 4,668,614 | 5/1987 | Takada et al. | 430/570 |
| 4,835,095 | 5/1989 | Ohashi et al. | 430/569 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide photographic material comprising a support having thereon at least one silver halide emulsion layer containing at least one emulsion in which chemically sensitized silver halide grains are composed of tabular silver halide grains having a diameter of a circle corresponding to the projected area of at least 0.4 μm and an average aspect ratio of at least 2 are present in a ratio of at least 50% based on the total projected area of all silver halide grains in the emulsion layer, the tabular silver halide grains having a stratified structure containing at least one layer distinguished from each other with planes substantially parallel to the two main planes facing each other thereof, an average iodine content of the outermost layer therein being higher than an average iodine content of the whole silver halide grain by at least 1 mole %, and where weight ratio (gold/silver) of the amount of gold coated per unit area to the amount of silver coated per unit area of the photographic material being not more than $8.0\times10^{-6}$. The silver halide photographic material is prevented from an increase in fog, a degradation of graininess and a decrease in sensitivity with the passage of time between the production and the use thereof.

22 Claims, 1 Drawing Sheet

SILVER HALIDE PHOTOGRAPHIC MATERIAL

FIELD OF THE INVENTION

The present invention relates to a silver halide photographic material, and more particularly to a silver halide photographic material using an emulsion composed of silver halide grains having a novel structure. Specifically, it relates to a silver halide photographic material which exhibits less increase in fog, less degradation of graininess and less decrease in sensitivity with the passage of time between the production and the use thereof.

BACKGROUND OF THE INVENTION

In recent years, photographic light-sensitive materials having high sensitivity have been rapidly put on the market with advances in technology relating to photographic light-sensitive materials for photography. As the result of reaching high sensitivity in photographic materials, the useful range of photographing has expanded to, for example, the case of photographing subjects in a dark room without using an electronic flash, the case of photographing subjects using a telephoto lens at high shutter speeds, such as a sport photographs and the case of photographing subjects requiring long exposure times, such as an astronomical photography.

To increase the sensitivity of photographic light-sensitive materials, many investigations have been made on various techniques including, for example, varying the shape, composition, preparation method, chemical sensitization and spectral sensitization of silver halide grains, the additives used and the structure of the couplers used, and some useful inventions have been also made. However, the requirement for photographic light-sensitive materials of high sensitivity has surpassed the progress of technology and thus these known methods are not satisfactory. Therefore, it has been conventional in the art to prepare photographic materials having high sensitivity by increasing the size of silver halide grains in combination with another technique(s) in order to increase sensitivity.

When the size of silver halide grains used in the emulsion is increased, sensitivity can be raised to a certain extent. However, if the content of silver halide is maintained constant, this necessarily results in decrease in the number of silver halide grains in the emulsion and, therefore, decreases the number of development initiating points, whereby a severe problem is encountered with graininess. In order to overcome this problem, many approaches have been known, for example:

Using a photographic light-sensitive material having at least two emulsion layers having the same spectral sensitivity and different sensitivities, that is, using silver halide grains of different sizes as described in British Patent No. 923,045 and JP-B-49-15495 (the term "JP-B" as used herein means an "examined Japanese patent publication"):

Using a coupler having high reactivity as described in JP-A 55-62454 (the term "JP-A" as used herein means an "unexamined published Japanese patent application"):

Employing a DIR coupler or DIR compound as described in U.S. Pat. Nos. 3,227,554 and 3,632,435:

Using a coupler which forms a mobile dye as described in British Patent No. 2,083,640: and Using a silver halide emulsion having a high average silver iodide content as described in JP-A-60-128443.

Although these methods represent excellent technologies which exhibit substantial effects, they are still insufficient to satisfy the current strict requirements for both high sensitivity and high image quality.

Accordingly, in order to increase the size of silver halide grains and simultaneously increase the number of development initiating points as much as possible, it has been suggested to increase the content of silver halide grains in color negative photographic materials of high sensitivity while maintaining other properties such as the desilvering property in a bleach-fixing processing.

Another technique for increasing sensitivity/graininess ratio is to utilize tabular silver halide grains as described in JP-A-58-108525, JP-A-58-111935, JP-A-58-111936, JP-A-58-111937, JP-A-58-113927 and JP-A-59-99433. Tabular silver halide grains are very advantageous for improvement of the sensitivity and size ratio of silver halide grains since they have a larger surface area than grains of other known forms such as cubic, octahedral, tetradecahedral, and "lump" forms at the same volume. This allows higher adsorption of sensitizing dye onto the grain surface. Considering that most of the currently employed silver halide photographic materials use a silver halide emulsion spectrally sensitized with a sensitizing dye absorbed thereon, the use of the tabular silver halide grains is highly effective to improve the sensitivity and image quality of silver halide photographic materials for practical use.

Silver halide employed in such photographic light-sensitive materials is normally subjected to chemical sensitization in order to obtain the desired sensitivity and gradation.

For the chemical sensitization of silver halide, it is known that sulfur sensitization in which compounds containing sulfur capable of reacting with a silver ion and active gelatin can be used, reduction sensitization in which reducing compounds are used and noble metal sensitization in which gold and other noble metal compounds are used, can be successfully employed, either singly or in combination.

Sulfur sensitizers which can be used include thiosulfates, thioureas, thiazoles, and rhodanines. Specific examples of these compounds are described in U.S. Pat. Nos. 1,574,944, 2,410,689, 2,278,947, 2,728,668, 3,656,955, 4,030,928 and 4,067,740.

Reduction sensitizers which can be used include stannous salts, amines, hydrazine derivatives, form-amidinesulfinic acid, and silane compounds. Specific examples of these compounds are described in U.S. Pat. Nos. 2,487,850, 2,419,974, 2,518,698, 2,983,609, 2,983,610, 2,694,637, 3,930,867 and 4,054,458.

For noble metal sensitization, in addition to gold complex salts, complex salts of Group VIII metals of the Periodic Table, e.g., platinum, iridium, and palladium, can be used. Specific examples of these compounds are described in U.S. Pat. Nos. 2,399,083 and 2,448,060, and British Patent No. 618,061.

Recently, it has been highly desired to increase the sensitivity of silver halide emulsions. In order to achieve this purpose, it is ordinarily necessary to use a sensitization method where a sulfur sensitizer and a noble metal sensitizer are used in combination, most particularly a gold and sulfur sensitization method where a sulfur sensitizer and a gold sensitizer are employed in combination from among the chemical sensitization methods described above.

In such a case, the amounts of these sensitizers to be added are determined depending on various factors including the state of silver halide crystal grains to be chemically sensitized (for example, the grain size, grain size distribution, halogen composition, and crystal habit), environmental conditions (for example, the amount and type of binder used, the pH, pAg, reaction temperature and reaction time), assistants for gold sensitization (for example, accelerators typically represented by thiocyanates or thioether compounds, and antifoggants typically represented by thiosulfonates), as well as the types of sulfur and gold sensitizer to be employed.

However, it has been found that photographic light-sensitive materials of high sensitivity thus prepared have problems. Specifically, these photographic materials are accompanied by a degradation of photographic performance such as an increase in fog, a reduction in sensitivity and a deterioration in graininess with the passage of time between the production thereof and use thereof.

It was previously found by one of the present inventors that a silver halide photographic material having high sensitivity and improved pressure resistance characteristics could be obtained using a tabular silver halide emulsion containing a dispersion medium and tabular silver halide grains having a diameter of at least 0.4 μm and an average aspect ratio of at least 2 in a ratio of at least 50% based on the total projected area of all silver halide grains in the emulsion, the tabular silver halide grains have a substantially stratified structure containing at least one layer having planes parallel to the two main planes facing each other thereof, and the average halogen composition of each layer in the material differing from that of each layer adjacent thereto by at least 1 mol %. This approach is described in JP-A-63-106746.

However, the effects obtained by the use of a combination with such a structure and a gold sensitization method according to the present invention could not be expected.

SUMMARY OF THE INVENTION

Therefore, an object of the present invention is to provide a silver halide photographic material of excellent stability in which an increase in fog, a decrease in sensitivity and a deterioration in graininess with the passage of time after the production thereof are restrained.

Other objects of the present invention will be apparent from the later presented detailed description and examples.

The objects of the present invention are accomplished by a silver halide photographic material comprising a support having thereon at least one silver halide emulsion layer containing at least one emulsion layer in which chemically sensitized silver halide grains are composed of tabular silver halide grains having a diameter (expressed as a circle corresponding to the projected area of at least 0.4 μm and an average aspect ratio of at least 2) are present in an amount of at least 50% based on the total projected area of all silver halide grains in the emulsion layer. The tabular silver halide grains have a stratified structure containing at least one layer which distinguishes from each other layer with planes substantially parallel to the two main planes facing each other thereof, the average iodine content of the outermost layer therein being higher than an average iodine content of the whole silver halide grain by at least 1 mol %, and a weight ratio (gold/silver) of the amount of gold coated per unit area to the amount of silver coated per unit area of the photographic material being not more than $8.0\times10^{-6}$.

BRIEF DESCRIPTION OF THE DRAWINGS

FIGS. (a) and (b) show a tabular silver halide grain of the present invention having a stratified structure containing at least one layer distinguished from each other with planes substantially parallel to the two main planes facing each other thereof.

FIG. (a) is a cross section of the tabular silver halide grain of the present invention, and, FIG. (b) is a plan view of the tabular silver halide grain of the present invention.

DETAILED DESCRIPTION OF THE INVENTION

Figure 1A:
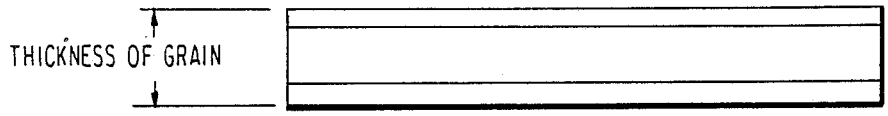
Figure 1B:
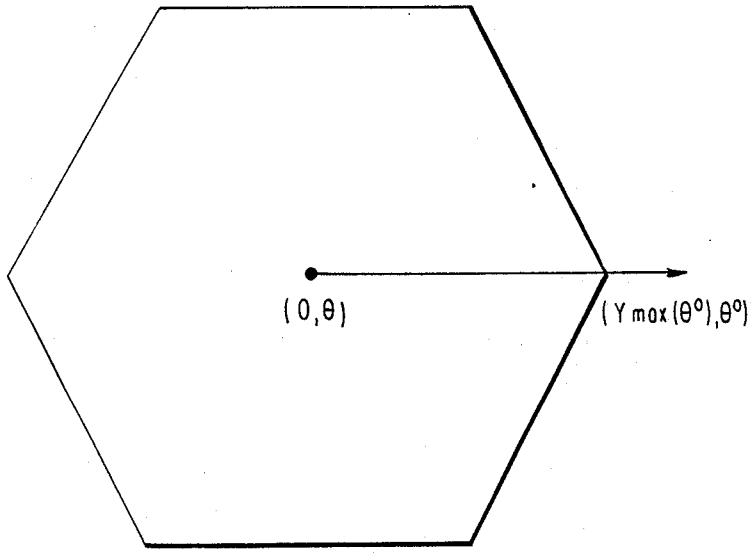

The factor which establish the importance of the problem solved according to the present invention will now be explained. Since the effect of the present invention is particularly remarkably recognized in high-sensitive color negative films, the following description mostly focuses on such films. However, the present invention can be widely applied to other high sensitive photographic materials, for example, high sensitive color reversal films, high sensitive black-and-white films, and high sensitive films for cinematography.

As a result of investigating films which were returned to processing laboratories, it was found that high sensitive color negative films were generally employed by customers one half year to a full year after the production thereof, and use of the films almost two year after production thereof was not unusual. It was also recognized that the properties of such high sensitive color negative films which were returned to processing laboratories exhibited some degradation, for example, an increase in fog, a deterioration in graininess or a decrease in sensitivity.

After research, the inventors discovered the factors described below and completed the present invention.

High sensitive color negative films were stored at room temperature in a lead box placed in an underground tunnel of Mihoro Dam. It was found that an increase in fog, a deterioration in graininess and a decrease in sensitivity of these films were significantly restrained as compared with films stored under ordinary conditions. The condition was characterized by the fact that the amount of natural radiation was extremely low since the tunnel blocked cosmic rays and the lead blocked γ-rays. Accordingly, it was discovered that the main factor involved in the degradation of the properties of high sensitive color negative films was natural radiation.

Various experiments were then conducted to confirm the factors which were relevant to the degradation in the properties of the films due to natural radiation.

As a result, it was surprisingly found that the influence of natural radiation was reduced as the content of the silver was decreased, as the weight ratio of the total gold coated amount to the total silver coated amount was decreased, or in the case where chemically sensitized silver halide grains in the photographic light-sensitive material were composed of tabular silver halide grains having a diameter (expressed as a circle corresponding to the projected area) of at least 0.4 μm and an average aspect ratio of at least 2 in an amount of at least 50% based on the total projected area of all silver halide grains in the emulsions layer, the tabular silver halide grains having a stratified structure containing at least one layer distinguished from each other with planes substantially parallel to the two main plains facing each other thereof, and an average iodine content of the outermost layer therein being higher than an average iodine content of the whole silver halide grain by at least 1 mol %. In addition, it is also found that the influence due to natural radiation was further reduced by combination of these factors.

It is important to note that although the effect obtained by each individual factor per the present invention is insufficient to achieve the purposes of the present invention, the combination of all factors produces the desired results.

A test made by the inventors showed that the graininess of a film (A) having a high silver content is more excellent than that of a film (B) having a low silver content just after the preparation thereof. However, the test also showed that, as time passed after the preparation, the difference in the properties between the two films (A) and (B) gradually became smaller and smaller due to an increase in fog, a deterioration in graininess and a decrease in sensitivity, and eventually the latter film surpassed the former film in quality.

However, a decrease in the total silver content results in a side-effect in that the resulting decrease in the number of developable center in the film results in a deterioration in the graininess.

According to the present invention, the influence of natural radiation on high sensitive photographic materials is decreased by means independent of the silver content thereof. Therefore, the means of the present invention is effective to avoid the problem of graininess just after the production and that after the passage of time with films (A) and (B) above noted.

It is preferred that the silver halide emulsion incorporated into the photographic light-sensitive material according to the present invention ordinarily be subjected to chemical sensitization with a sulfur sensitizing agent and a gold sensitizing agent in combination.

If the gold/silver weight ratio is decreased by merely decreasing the amount of gold incorporated, such causes some problems such as decrease in sensitivity or low contrast. Therefore, to decrease the side effect due to a reduction of the weight ratio of the total gold amount to the total silver amount, a step to remove free gold is conducted after the chemical sensitization, whereby the side effect due to the reduction of the gold/silver weight ratio is minimized. In order to remove the free gold (compounds), washing with water as described in *Research Disclosure,* No. 17643, Item IIA (December, 1978) can be employed.

Examples of suitable methods to remove the free gold (compounds) will now be described.

(a) A method which comprises processing an emulsion which has been gold sensitized with a porous adsorbent or ion exchange resin before the time it is coated on a support to remove gold sensitizing agent remaining in the binder phase by an adsorption effect.

The term "porous adsorbent" as used herein means a porous solid adsorbent (adsorption medium) having a high surface area. Specific examples of such a porous solid adsorbent include inorganic porous adsorbents such as activated carbon, active alumina, active clay, silica based adsorbents (preferably water-resistant), zeolite based adsorbents, porous glasses and porous ceramics.

Among these adsorbents, activated carbon is most preferably used.

Specific examples of the ion exchange resin include cation exchange resins (e.g., Amberlite IR-120 (Rohm & Hass Inc.)), anion exchange resins (e.g., Diaion SA-21A (Mitsubishi Chemical Industries Ltd.), Dowex 1×8 (Dow Chemical)), and amphoteric ion exchange resins and chelate resins (e.g., Diaion CR-20 (Mitsubishi Chemical Industries Ltd.)).

These ion exchange resins are commercially available in many varieties depending on their application.

Among these ion exchange resins, anion exchange resins, amphoteric ion exchange resins and chelate resins are preferably used in the present invention. Anion exchange resins are most preferably used.

Specific examples of the use of these adsorbents and ion exchange resins are given in detail in JP-A-61-219948 and JP-A-61-219949.

(b) A method which comprises washing an emulsion which has been gold sensitized with water before the time it is coated on a support.

The water washing process may be accomplished by a conventional flocculation process or noodle process. The water washing solution used in this process may be water per se or an aqueous solution of a halogenated alkali, thiocyanate or sulfite.

(c) A method which comprises subjected an emulsion which has been gold sensitized to centrifugal separation or another mechanical separation process to remove the binder phase containing a gold sensitizing agent left therein by a necessary amount, and then adding a further necessary amount of a binder.

(d) A method which comprises using a smaller amount of gelatin as a diluent to decrease the amount of gelatin present in the silver halide emulsion upon gold sensitization.

(e) A method which comprises the combined use of a gold compound with a palladium compound, such as palladium chloride.

Methods (a) to (e) may be used singly or in combination.

By use of a weight ratio of total gold amount to total silver amount of not more than $8.0\times10^{-6}$, the objects of the present invention can be accomplished. The lesser the amount of gold, the greater the effect of the present invention. However, when the amount of gold is too small, a deterioration in photographic properties can not be sufficiently prevented at times even if the gold sensitization is effectively conducted in the above described manner. The weight ratio of total gold amount to total silver amount is preferably in the range of from $2\times10^{-8}$ to $6\times10^{-6}$, and more preferably from $1\times10^{-7}$ to $2\times10^{-6}$.

As suitable gold sensitizing agents, for use in the present invention there are preferably used a gold complex as described, for example, in U.S. Pat. No. 2,399,083.

Particularly preferred among these compounds are chloroauric acid, potassium chloroaurate, potassium aurithiocyanate, auric trichloride, sodium aurithiosulfate, and auric-5-sulfobenzothiazole-2-sulfide chloride.

In the present invention, a sulfur sensitization process is preferably used in combination with the above described gold sensitization process.

Examples of suitable sulfur sensitizing agents which can be used in the present invention include thiosulfates, thioureas, thiazoles, rhodanines and other compounds as described in U.S. Pat. Nos. 1,574,944, 2,410,689, 2,278,947, 2,728,668, 3,656,955, 4,030,928 and 4,067,740. Particularly preferred among these compounds are thiosulfates, thioureas and rhodanines.

In general, the red-sensitive silver halide emulsion layer, green-sensitive silver halide emulsion layer and blue-sensitive silver halide emulsion layer which constitute a color negative photographic light-sensitive material each consists of two or more light-sensitive layers having different sensitivities to provide a wide exposure latitude and improved graininess as described in British Patent No. 923,045 and JP-B-49-15495.

These light-sensitive layers can comprise silver halide grains having various sizes. Most preferably, a gold compound is used in a substantial proportion of the total surface area of the silver halide grains (surface area of one grain × number of grains). However, the objects of the present invention can be accomplished if one only decreases the amount of gold compound used in the gold sensitization of the silver halide grains in the layer having the highest sensitivity in the red-sensitive layer, the green-sensitive layer and the blue-sensitive layer. In this case, the movement or rearrangement of gold may occur during the production or storage of the photographic light-sensitive material.

When the weight ratio of total gold amount to total silver amount is $8\times10^{-6}$ or less, the effect of using a reduction sensitization process becomes higher.

Suitable reduction sensitizing agents include stannous salts, amine salts, hydrazine derivatives, formamide sulfinic acid and silane compounds. Specific examples of these compounds are described in U.S. Pat. Nos. 2,487,850, 2,419,974, 2,518,698, 2,983,609, 2,983,610, 2,694,637, 3,930,867, and 4,054,458.

The reduction sensitization may also be accomplished by other suitable methods as described in JP-A-48-87825, JP-B-58-1410, and U.S. Pat. No. 4,175,970.

Alternatively, the photographic light-sensitive material may be sensitized with hydrogen gas as described in T. A. Babcock et al., *Photographic Science & Engineering*, 19, pp. 211 to 214, 49 to 55, 1975.

Determination of the amount of gold is preferably effected by a simple and accurate analysis such as atomic absorption spectroscopy. In the Examples herein, Hitachi, Ltd.'s polarization Zeeman atomic-absorption spectrometer Type 180-80 was used. A 5-mm specimen punched out from the coating of photographic light-sensitive layer(s) on a support was subjected to high temperature carbon furnace atomic absorption spectroscopy.

Preferably, 70% to 100%, more preferably 80% to 100%, of the total amount of gold is present in the silver halide grain phase.

The proportion of gold present in the silver halide grain phase can be determined by the following analysis:

(i) The photographic layer(s) coated on a support is/are swollen with water. The silver halide emulsion layer(s) and any other photographic layer(s) is/are then peeled off the support by enzymatic decomposition or acid decomposition. The silver halide emulsion(s) is/are then subjected to centrifugal separation so that a silver halide grain solid phase and a binder phase are separated from each other. Each of these phases is then subjected to the above described analysis to determine the amount of a gold sensitizing agent (including gold or gold compounds).

(ii) When a coated photographic layer(s) on a support is/are fully washed with a dilute (e.g., 0.01%) aqueous solution of sodium thiosulfate in a manner such that the silver halide incorporated therein is not fixed, almost all the gold sensitizing agent in the binder phase is washed out. By determining the total amount of the gold sensitizing agent incorporated in the coated layer(s) before and after being treated with the sodium thiosulfate bath, the amount of the gold sensitizing agent incorporated in the silver halide grain solid phase and the binder phase can be established.

Method (ii) is described in detail in P. A. Fälens, "Photographische Korrespondenz", Vol. 104, pp. 137 to 146, 1968.

In the present invention, method (ii) is preferably used.

The term "total amount of gold" to be incorporated in a unit area of the photographic light-sensitive material means the total amounts of gold sensitizing agent(s) incorporated per unit area of all layers, including silver halide emulsion layers, in the photographic light-sensitive material (amount of gold determined by atomic absorption spectroscopy).

If the silver halide grain phase has a small proportion of gold, i.e., the binder phase has a large proportion of gold, gold diffuses or moves to the silver halide grain phase between chemical sensitization and coating of the silver halide emulsion on a support or with the passage of time after coating. It is believed that this makes the photographic light-sensitive material more susceptible to undesirable changes in photographic properties such as sensitivity, gradation or fog due with the passage of time.

The silver halide emulsion according to the present invention comprises a dispersion medium and silver halide selected from silver iodobromide, silver chloroiodobromide and silver chloroiodide which has the following features (1) and (2):

(1) tabular silver halide grains having a diameter (as a circle corresponding to the projected area) of at least 0.4 μm and an average aspect ratio of at least 2, preferably from 2.5 to 50, more preferably from 3 to 30 and most preferably from 4 to 20 comprise at least 50%, preferably at least 60% and more preferably at least 70%, of the total projected area of all silver halide grains in the emulsion, and (2) the tabular silver halide grains have a stratified structure containing at least one layer distinguished from each other with planes substantially parallel to the main planes facing each other thereof and the average iodine content of the outermost layer therein is higher than the average iodine content ($\bar{I}w$) of the whole silver halide grain by at least 1 mol %.

The terminology "average aspect ratio ($\bar{\gamma}$)" as used herein is defined by equation (1):

$$\bar{\gamma} = \left(\sum_{i=1}^{N} \frac{D_i}{t_i}\right)/N \qquad (1)$$

wherein $D_i$ represents the diameter of a circle having the same area as the projected area of the "i"th silver halide grain, the grain being placed so that the two main planes facing each other of the tabular grains are horizontal (hereinafter referred simply to as "diameter corresponding circle"); $t_i$ represents the grain thickness in the direction perpendicular to the two main planes (hereinafter referred simply to as "grain thickness");

and N represents a number of silver halide grains necessary and sufficient to calculate an average value.

In equation (1), the value N usually meets formula (2):

$$N \gtrsim 600 \quad (2)$$

Equation (1) indicates that $\bar{\gamma}$ can be obtained as an average of the aspect ratio $\gamma_i$ of each silver halide grain. If the silver halide grains substantially meet relationship (3):

$$t_i \simeq t_j \quad (3)$$

wherein $i \neq j$; and i and $j \leqq N$, or substantially meet relationship (4):

$$D_i/t_i \simeq D_j/t_j \quad (4)$$

wherein $i \neq j$; and i and $j \leqq N$, then, $\bar{\gamma}'$ defined by equation (5):

$$\bar{\gamma}' = \left(\sum_{i=1}^{N} D_i\right) / \left(\sum_{i=1}^{N} t_i\right) \quad (5)$$

is substantially equal to $\bar{\gamma}$. Accordingly, the average aspect ratio may be obtained as $\bar{\gamma}'$ as far as errors are within a range allowable for grain size measurement.

The average aspect ratio of the tabular silver halide grains and the ratio of tabular silver halide grains (to all grains) in an emulsion can be determined as follows. An electron micrograph is taken of a sample emulsion, and the diameter and thickness of the individual grains in the micrograph are measured. The average aspect ratio is then calculated for all grains having a diameter of 0.4 μm or greater. On the other hand, the sum of the projected areas of individual grains having a diameter of 0.4 μm or greater (St) and the sum of the projected areas of individual grains having a diameter of less than 0.4 μm (Sn) are calculated. The ratio of those grains having a diameter of 0.4 μm or greater among the total grains [St/(St+Sn)×100%] can then be obtained.

The method for measurement of the average aspect ratio is described, for example, in JP-A-58-113926, JP-A-58-113930 and JP-A-58-113934.

In the tabular silver halide wherein the average iodide content of the outermost layer therein is higher than the average iodide content ($\bar{I}_w$) of the whole silver halide grain by at least 1 mol %, the average iodide content ($\overline{I_o(XPS)}$) in the surface layer region of a silver halide grain which is obtained by XPS (X-ray Photoelectron Spectroscopy) is higher than the average iodide content ($\bar{I}_w$) of the whole silver halide grain by at least 1 mol %. This quantitative analysis is conducted by exciting inner shell electrons in the 3d orbital of Ag and I in the silver halide grain with characteristic soft X-rays from Al or Mg and analyzing the restricted energy thereof. On the other hand, the average iodine content ($\bar{I}w$) of the whole silver halide grain can be measured by fluorescent X-ray analysis, although various other methods may be employed.

The tabular silver halide grain has a stratified structure containing at least one layer distinguished from each other with planes substantially parallel to the main planes facing each other thereof. The structure in the direction parallel to the two main planes facing each other is determined in the following manner. The average iodine content in a minute region in the direction perpendicular to the two main planes facing each other extending from the surface of the grain to the interior thereof is taken as $\bar{I}_A$. When an origin is fixed at the center of the two main planes facing each other of the tabular silver halide grain and polar coordinates ($\gamma$, $\theta$) are set parallel to the two main planes, $\bar{I}_A$ can be defined as a function of ($\gamma$, $\theta$), i.e., $\bar{I}_A(\gamma, \theta)$.

In accordance with the above definition, $\bar{I}_A(\gamma, \theta)$ denotes the average iodine content in the minute region between the two main planes facing each other at the center of the main planes. The position of the edge is represented by the polar coordinates ($\gamma_{max}(\theta)$, $\theta$), when the maximum value of $\gamma$ which is provided to at an arbitrary $\theta$ is $\gamma_{max}(\theta)$. The value $\gamma_{max}(\theta)$ represents the distance between the center of the main plains and the edge of the grain positioned in the direction $\theta$.

With the structure in the direction parallel to the two main planes of the silver halide grain according to the present invention it is preferred that $\bar{I}_A(\gamma, \theta)$ is substantially constant to arbitrary ($\gamma$, $\theta$). On the other hand, when $\bar{I}_A(\gamma, \theta)$ is not constant to arbitrary ($\gamma$, $\theta$), it is necessary to have $\gamma$ which satisfies the relationship of $\bar{I}_A(\gamma_{max}(\theta), \theta) < \bar{I}_A(\gamma, \theta)$ wherein $\gamma < \gamma max(\theta)$.

When the above described conditions are met, a stratified structure having different iodine contents is formed around the main planes of the tabular silver halide grain according to the present invention.

The measurement of $\bar{I}_a$ can be conducted, for example, by electron mioroscopic analysis.

The XPS method and its basic operation used for analyzing the iodine content in the surface region of the silver halide grains is described in Junichi Aihara et al. *Denshi no Bunko (Spectroscopy of Electrons), Kyoritsu Library* 16 (Kyoritsu Shuppan, 1978).

A standard method of XPS is to use Mg-kα as the exciting X-ray source and to measure the intensity of the photoelectrons of iodine (I) and silver (Ag) (usually I-$3d_{5/2}$ and Ag-$3d_{5/2}$) released from the silver halide grains of the sample.

The iodine content can be determined by using a calibration curve of the intensity ratio of photoelectrons from iodine (I) to those from silver (Ag) (intensity (I)-/intensity (Ag)), prepared by using several standard samples having a known iodine content. With silver halide emulsions, the XPS must be performed after decomposing any gelatin adsorbed on the surface of silver halide grains with protease or the like to remove the gelatin.

The above-described tabular silver halide grains having a stratified structure can be prepared as follows. At the time when at least 50% of the total silver amount to be fed for grain formation has been added to the liquid phase used for grain growth, the tabular silver halide grain formed is taken as $y_0$. Onto $y_0$ there is further precipitated a silver halide layer ($x_1$) to obtain a silver halide grain ($y_1$). When the above-described operation is repeated n times in accordance with conditions (a), (b), and (c) shown below (this operation is noted as ⊕ in the below equation), there is established, in principle, a relationship represented by the equation:

$$y_i \oplus x_{i+1} = y_{i+1}$$

wherein i=0, 1, . . . , n.

The thus obtained final silver halide emulsion ($y_{n+1}$) is a tabular silver halide grain emulsion according to the present invention.

(a) $y_i$ and $x_{i+1}$ differ in average iodine content by at least 1 mol %. That is, the average iodine contents of $y_i$ and $x_{i+1}$ are represented by $$AgBr_{1-\alpha-\beta}I_{\alpha}Cl_{\beta}, \text{ and}$$

$$AgBr_{1-\alpha'-\beta'}I_{\alpha'}Cl_{\beta'},$$

respectively, $$|\alpha'-\alpha| \leqq 0.01$$

for i=0, 1, . . . , n.

(b) During the process where $x_{i+1}$ is precipitated on $y_i$, the grain $y_{i+1}$ grows in a direction substantially perpendicular to the two main planes of $y_i$ which face each other.

(c) n is 0 or an integer of 10 or less.

The tabular silver halide grain $y_0$ as above-illustrated can be formed by an appropriate combination of methods known in the art. For reference, the tabular silver halide emulsions are described, for example, in Cagnac and Chateau, "Evolution of the Morphology of Silver Bromide Crystals During Physical Ripening" (1962), *Science et Industrie Photographique,* Vol. 33, No. 2, pp. 121 to 125 (1962); Duffin, *Photographic Emulsion Chemistry,* pp. 66 to 72, (Focal Press, New York 1966), and A. P. H. Trivelli and W. F. Smith, *Photographic Journal,* Vol. 80, p. 285 (1940). These silver halide grains can be prepared easily by reference to the methods as described, for example, in JP-A-58-127921, JP-A-58-113927 and JP-A-58-113928.

More specifically, such tabular silver halide grains having a stratified structure can be prepared by forming seed crystals containing at least 40% by weight of tabular seeds in a medium having a relatively low pBr value (for example, 1.3 or less) and then allowing the seed crystals to grow by simultaneously adding a silver salt solution and a halogen salt solution while keeping the pAg value between 6.0 and 9.15, preferably between 6.8 and 9.0.

During the grain growth stage, it is desirable to add silver and halogen solutions to the system in such a manner that new crystal nuclei are not formed.

The size of the tabular silver halide grains can be adjusted by temperature control, selection of the kind and amount of a solvent used, control of the feed rates of silver salt and halide during grain growth, and the like.

In an emulsion containing a tabular silver halide grain of the present invention, when the projected area of the total silver halide grain of the present invention becomes at least 50% (which is counted from the larger projected area) in the emulsion, the average aspect ratio of the counted grain is at least 2. The average aspect ratio is preferably from 2.5 to 50, more preferably from 3 to 30, and further preferably from 4 to 20. The diameter of a circle corresponding to the projected area is at least 0.4 μm, preferably from 0.6 μm to 20 μm, and more preferably from 0.8 μm to 10 μm.

Further, the size, form (for example, aspect ratio), size distribution, and rate of growth of the tabular silver halide grains can be controlled by using a silver halide solvent and/or adjusting the pAg value during the preparation. For example, a monodispersed grain size distribution can be attained and grain growth can be accelerated by increasing the amount of a solvent used. To the contrary, an increase of the solvent amount and/or a decrease of the pAg tends to increase the grain thickness.

Acceleration of grain growth can be preferably achieved by increasing the feed rate, amount, and concentration of each of the silver salt solution (for example, a silver nitrate aqueous solution) and the halide solution (for example, a potassium bromide aqueous solution), as disclosed in, for example, British Patent No. 1,335,925, U.S. Pat. Nos. 3,762,900, 3,650,757 and 4,242,445, JP-A-55-142329, JP-A-55-158124, JP-A-58-113927, JP-A-58-113928, JP-A-58-113934 and JP-A-58-113936.

The tabular silver halide emulsion according to the present invention is subjected to chemical sensitization. Chemical sensitization can be carried out by a gold sensitization method using a gold compound as described, for example, in U.S. Pat. Nos. 2,448,060 and 3,320,069; a noble metal sensitization method using other noble metals, for example, iridium, platinum, rhodium or palladium as described, for example, in U.S. Pat. Nos. 2,448,060, 2,566,245 and 2,566,263; a sulfur sensitization method using a sulfur-containing compound as described, for example, in U.S. Pat. No. 2,222,264; a reduction sensitization method using a reducing agent, for example, tin salts or polyamines as described, for example, in U.S. Pat. Nos. 2,487,850, 2,518,698 and 2,521,925; or a combination of two or more thereof. In particular, the tabular grains used in the present invention are preferably chemically sensitized by a combination of gold sensitization and sulfur sensitization from the standpoint of attaining high sensitivity.

The tabular silver halide grains used in the present invention may have any halogen composition, such as silver iodobromide, silver chloroiodobromide, and silver chloroiodide.

The tabular grains having a stratified structure according to the present invention can be obtained by forming tabular seed crystals, $y_0$, by the above described conventional methods and adding a silver salt and a halide at a specific pAg value to thereby allow the seed crystals to grow mainly in the direction of their thickness without causing any substantial growth in the diameter direction. Therefore, the average diameter of a corresponding circle $\overline{D}_{n+1}$ of the finally obtained crystal $y_{n+1}$ is substantially equal to or somewhat smaller than the average diameter corresponding circle $\overline{D}_0$ of the seed crystal $y_0$.

The term "substantially equal" means that the change in grain thickness divided by the change in grain diameter for the total grains is not less than about 2, preferably not less than about 2.5, and more preferably not less than about 3, or it means the change of in grain thickness divided by the change in grain diameter for grains having a diameter corresponding to a circle of 0.6 μm or more is not less than about 9, preferably not less than about 10, and more preferably not less than about 11.

The term "change in grain thickness/diameter" as used herein means the quotient obtained by dividing the difference between the grain thickness or diameter corresponding to a circle of grain in the initial stage of grain growth and that in the final stage by the grain thickness or diameter corresponding to a circle of the grain in the initial stage of grain growth, respectively.

The term "grain thickness" or "grain diameter corresponding to a circle" as used herein means the arithmetic mean of grain thickness or diameter, respectively, for the number of grains necessary for determining an average for the grain system in any particular stage.

The aforesaid change in grain diameter or thickness can be determined through analysis of, for example, an electron micrograph of an emulsion. However, it is sometimes difficult to determine these changes with high accuracy. Such being the case, the changes can be measured by the following method. Immediately after the completion of grain growth, appropriate amounts of a silver nitrate aqueous solution and a halogen aqueous solution are added to the system (emulsion) while maintaining factors specifying the direction of grain growth, such as pAg, pH, temperature, and solvent concentration of the system, etc., substantially constant and maintaining the surface halogen composition of the silver halide grains in the final stage of grain growth unchanged. The aforesaid difference in grain diameter or thickness can thus be obtained with sufficiently high accuracy.

The tabular grains having a stratified structure according to the present invention have an inner layer corresponding to the seed crystal $y_0$ and at least one outer layer deposited thereon and include various embodiments. Preferred embodiments of the grain structure are described below.

(1) A structure composed of an inner layer containing silver iodobromide (AgBrI) and an outer layer containing silver iodobromide (AgBrI) on each side of the two main planes of the inner layer, with the outer layers containing from 1 to 50 mol %, preferably from 2 to 40 mol %, and more preferably from 5 to 15 mol %, of silver based on the total silver content per grain.

(2) A structure composed of an inner layer containing silver chloroiodobromide (AgBrClI) and an outer layer containing silver (chloro)iodobromide (AgBr(Cl)I) on each side of the two main planes of the inner layer, with the outer layers containing from 1 to 50 mol %, preferably from 2 to 40 mol %, and more preferably from 5 to 15 mol %, of silver based on the total silver content per grain.

(3) A structure composed of an inner layer containing silver bromide (AgBr) and an outer layer containing silver iodobromide (AgBrI) on each side of the two main planes of the inner layer, with the outer layers containing from 1 to 50 mol %, preferably from 2 to 40 mol %, and more preferably from 5 to 15 mol %, of silver based on the total silver content per grain.

In the silver halide grain according to the present invention the average iodine content of the outer layer is higher than the average iodine content of the whole silver halide grain by at least 1 mol %, preferably at least 1.5 mol %, and more preferably at least 2 mol %.

The iodine content of the outer layer is from 1 to 40 mol %, preferably from 2 to 20 mol %, and more preferably from 6 to 13 mol %.

With a composition other than silver iodide in the outer layer, it is preferred that the ratio of silver bromide be high, but silver chloride may be present.

Structures (1) to (3) may further comprise one or more outer layers. For example, the structure of an inner layer containing silver iodobromide (iodine content: from 1 to 5 mol %) and an outer layer containing silver iodobromide (iodine content: from 5 to 20 mol %) on each of the main planes of the inner layer may further have an outermost layer comprising silver iodobromide (iodine content: from 20 to 40 mol %) on each of the main planes of the first outer layer.

It is preferred that the tabular grains having a stratified structure according to the present invention have a substantially uniform structure in the direction parallel to the two main planes as described above. The terminology "substantially uniform structure in the direction parallel to the two main planes" as used herein means that any part of the seed crystal $y_0$ in the preparation of silver halide grain according to the present invention has approximately the same halogen composition. However, when the seed crystal $y_0$ has been formed by growth of a microfine crystal as a nucleus, the portion corresponding to the nucleus (not exceeding 15 mol % based on the total silver content of the seed crystal $y_0$) may have a different halogen composition from that of the rest of the seed crystal. Therefore, the term "substantially uniform halogen composition" in the seed crystal $y_0$ means that any part of the seed crystal except for its nucleus has approximately the same halogen composition.

The seed crystal $y_0$ is preferably from 50 to 99 mol %, and more preferably from 60 to 95 mol %, of the whole grain.

The tabular silver halide grains according to the present invention have an average aspect ratio ranging from 2 to 50, preferably from 3 to 20, and more preferably from 4 to 10.

During the process of the formation, physical ripening or chemical ripening of the silver halide grains, a cadmium salt, a zinc salt, a lead salt, a thallium salt, an iridium salt or a complex salt thereof, a rhodium salt or a complex salt thereof, an iron salt or a complex salt thereof, may be present in the system.

The photographic emulsion containing tabular silver halide grains according to the present invention is particularly preferably subjected to spectral sensitization or super-sensitization. Further, other techniques for increasing sensitivity are preferably employed in combination therewith. Details thereof will be described hereinafter.

The emulsions used in the present invention may have a broad grain size distribution, but emulsions with a narrow grain size distribution are preferred. Particularly in emulsions containing normal crystal grains, monodispersed emulsions in which 90% (by weight or number) of the total silver halide grains have grain sizes within ±40%, more preferably ±30%, of the average grain size are preferred.

In order to prepare a tabular silver halide emulsion with a narrow grain size distribution as described above which can be used in the present invention, the methods described in JP-A-63-151618 can be used.

After preparation of silver iodobromide seed crystals containing a high content of silver iodide, uniform silver iodobromide can also be prepared by a process which involves accelerating the rate of addition with the passage of time as disclosed in JP-B-48-36890 Irie and Suzuki, or by a process of increasing the concentrations of added solutions with the passage of time to cause silver iodobromide grains to grow as disclosed in U.S. Pat. No. 4,242,445 for Saito. These processes give particularly preferable results. The process of Irie et al is a process of preparing photographic, slightly soluble inorganic crystals by a double decomposition reaction through simultaneous addition of substantially equal amounts of two or more aqueous solutions of inorganic salts in the presence of a protective colloid. The aqueous solutions of inorganic salts reacted are added at an addition rate not slower than a definite level and at a rate Q which is not more than the addition rate in proportion to the total surface area of the slightly soluble inorganic salt crystals under growth, i.e., not slower than $Q=\gamma$ and not faster than $Q=\alpha t^2+\beta t+\gamma$ (wherein $\alpha$, $\beta$ and $\gamma$ are constants which are experimentally determined, and t represents the time from the beginning of the reaction).

The Saito process is a process of preparing silver halide crystals by simultaneously adding two or more aqueous solutions of inorganic salts in the presence of a protective colloid, in which the concentrations of the aqueous solutions of inorganic salts to be reacted are increased to such a degree that new crystal nuclei are substantially not produced during the crystal growth period.

In addition, the emulsion preparation processes which are described in JP-A-60-138538, JP-A-61-88253, JP-A-59-177535, JP-A-61-112142 and JP-A-60-143331 may be used to prepare the emulsions of the present invention.

There are many techniques for introducing silver iodide into the silver halide grains according to the present invention. Silver iodide in the substration $y_0$ may be transferred into the outer layer upon addition of an aqueous solution of a water-soluble bromide salt and an aqueous solution of a water-soluble silver salt according to the double jet process. In this case, the amount and distribution of silver iodide in the outer layer can be controlled by adjusting the pAg during the addition or using a silver halide solvent. Alternatively, an aqueous solution of a mixture of a water-soluble bromide and a water-soluble iodide and an aqueous solution of a water-soluble silver salt may be added according to the double jet process, or an aqueous solution of a water-soluble bromide, an aqueous solution of water-soluble iodide, and a water-soluble silver salt may be added according to the triple jet process.

In order to introduce silver iodide into the grain surface or the portion of 50 to 100Å from the surface, an aqueous solution containing a water-soluble iodide can be added, or 0.1 μm or smaller silver iodide fine grains or silver halide fine grains having a high silver iodide content can be added after formation of the grains.

The silver halide emulsion used in the present invention is chemically sensitized. Chemical sensitization can be conducted according to the processes described, for example, in H. Frieser, *Die Grundlaqen der Photographischen Prozesse mit Silberhalogeniden* pp. 675 to 734 (Akademische Verlagsgesellschaft, 1968).

More specifically, a sulfur sensitization method using active gelatin or sulfur-containing compounds capable of reacting with silver (for example, thiosulfates, thioureas, mercapto compounds, rhodanines); a reduction sensitization method using reducing substances (for example, stannous salts, amines, hydrazine derivatives, formamidine sulfinic acid and silane compounds); and a noble metal sensitization method using compounds of noble metals (for example, complexes of group VIII metals of the periodic Table such as Pt, Ir, Pd, etc., as well as gold complex salts) may be employed alone or in combination.

Specific examples of the sulfur sensitization method are described in U.S. Pat. Nos. 1,574,944, 2,410,689, 2,278,947, 2,728,668 and 3,656,955; specific examples of the reduction sensitization method are described in U.S. Pat. Nos. 2,983,609, 2,419,974 and 4,054,458; and specific examples of the noble metal sensitization method are described in U.S. Pat. Nos. 2,399,083 and 2,448,060, and British Patent No. 618,061.

As a protective colloid used in the preparation of the emulsion of silver halide grains in accordance with the present invention, or as a binder for other hydrophilic colloidal layers, gelatin is advantageously used. However, other conventional hydrophilic colloids can be used as well. For example, proteins such as gelatin derivatives, graft polymers of gelatin and other polymers, albumin, casein, etc.; saccharides such as cellulose derivatives such as hydroxyethyl cellulose, carboxymethylcellulose, cellulose sulfate, etc., sodium alginate, starch derivatives, etc.; and various synthetic hydrophilic high molecular weight substances such as homopolymers or copolymers of, for example, polyvinyl alcohol, polyvinyl alcohol semiacetal, poly-N-vinylpyrrolidone, polyacrylic acid, polymethacrylic acid, polyacrylamide, polyvinyl imidazole, polyvinyl pyrazole, etc., can be used.

As the gelatin, conventional acid-processed gelatin or enzyme-processed gelatin as described in *Bull. Soc. Sci. Phot. Japan,* No. 16, p. 30 (1966) may be used, as well as lime-processed gelatin. Further, a gelatin hydrolyzate or an enzyme decomposition product of gelatin may also used.

As described above, the lower the silver content in the photographic light-sensitive material is, the less is the photographic light-sensitive material subject to the influence of natural radiation. Therefore, in order to increase the stability of the photographic light-sensitive material, it is preferred to reduce the silver content in the photographic light-sensitive material. On the other hand, a high silver content is preferred from the standpoint of improving latitude and graininess just after preparation. Therefore, the photographic light-sensitive material according to the present invention has a silver content of 3.0 to 13.0 g/m$^2$, preferably 4.5 to 10.0 g/m$^2$, more preferably 5.0 to 9.0 g/m$^2$, particularly preferably 5.5 to 8.0 g/m$^2$.

The term "silver content" as used herein means the content of all silver (elemental or compounds) such as silver halide and metallic silver as calculated in terms of grams of silver. The determination of the silver content in the photographic light sensitive material can be accomplished by any suitable known method. Fluorescent X-ray analysis is conveniently employed.

It is preferred that the approach for providing a silver halide emulsion having a higher sensitivity or other approaches for improving the image quality be combined with the present invention.

When the photographic light sensitive material of the present invention comprises at least one red-sensitive silver halide emulsion layer, at least one green-sensitive silver halide emulsion layer and at least one blue-sensitive silver halide emulsion layer, it is preferable that one or more color-sensitive emulsion layers be formed of two or more emulsion layers having different sensitivities. If a color-sensitive layer is formed of three emulsion layers, a further improvement in the graininess may be preferably attained. These approaches are described in British Patent No. 923,045, and JP-B-49-15495.

In a color negative photographic light-sensitive material, when a color-sensitive emulsion layer is formed of two or more emulsion layers having different sensitivities, the silver content in an emulsion layer having higher sensitivity is increased to utilize the effect of eliminating the graininess. This design is a common approach to obtain a color negative photographic light-sensitive material having high image quality. However, it was found that a high sensitive negative color photographic light-sensitive material has an unexpected disadvantage that if the silver content in an emulsion layer having a higher sensitivity is increased, one encounters greater aging deterioration after storage as compared to the case where the silver content in an emulsion layer having a low sensitivity is increased. Therefore, it is preferred that the silver content in the emulsion layer having the highest sensitivity in the emulsion layers of any color-sensitive layer not be too high. Thus, the silver content in the respective emulsion layer having the highest sensitivity in the red-sensitive layer, the green-sensitive layer and the blue-sensitive layer is preferably in the range of from 0.3 to 2.5 g/m$^2$, more preferably from 0.4 to 2.0 g/m$^2$, and particularly preferably from 0.5 to 1.7 g/m$^2$.

Specific examples of approaches for providing high sensitivity which can be preferably combined with the present invention will be described hereinafter, but the present invention should not be construed as being limited thereto.

In order to satisfy the desired high sensitivity and high image quality at the same time, various inventions have been made with respect to the order of layer arrangement. These approaches may preferably be combined with the present invention. These inventions with respect to the order of layer arrangement are described, for example, in U.S. Pat. Nos. 4,184,876, 4,129,446, 4,186,016, 4,186,011, 4,267,264, 4,173,479, 4,157,917, and 4,165,236, British Patent Nos. 1,560,965, 2,138,962, 2,137,372, JP-B-53-37017, and JP-A-59-177552, JP-A-59-180556, and JP-A-59-204038.

Alternatively, a light-insensitive layer may be present interposed between two or more emulsion layers having the same spectral sensitivity.

A reflective layer comprising finely divided silver halide grains may be provided under a higher sensitive layer, particularly under a higher sensitive blue-sensitive layer, to improve sensitivity. This approach is described, for example, in JP-A-59-160135.

Alternatively, as described in U.S. Pat. No. 3,497,350 or JP-A-59-214853, the spectral sensitivity may be property combined with a dye-forming coupler, and the layer thus obtained may be provided farthest from the support.

The photographic emulsion layer used in the silver halide photographic material of the present invention may further comprise other silver halide grain than that of the present invention, such as silver bromide, silver iodobromide, silver iodochlorobromide, silver chlorobromide or silver chloride. A preferred silver halide is silver iodobromide containing 30 mol % or less of silver iodide. A particularly preferred silver halide is silver iodobromide containing 2 to 20 mol % of silver iodide. In order to attain high sensitivity and high image quality at the same time, the average silver iodide content in silver halide incorporated in all the emulsion layers is preferably 8 mol % or more as described in JP-A-60-128443. It has been known that an increase in the average silver iodide content in a silver halide provides a remarkable improvement in graininess. However, when the silver iodide content exceeds a certain value, some disadvantages appear, such as a delay in development, desilvering or fixing. Nevertheless, in the present invention, since the photographic light-sensitive material has a low silver content, such disadvantages do not easily occur even if the silver iodide content is increased.

The photographic emulsion layer of the present invention may contain other conventional silver halide grain than that of the present invention.

The silver halide grains incorporated in the photographic emulsion layer in the silver halide photographic material of the present invention may preferably have a double structure having a core substantially comprising silver iodobromide containing 5 mol % or more of silver iodide and a shell covering the core and substantially comprising silver bromide or silver iodobromide having a lower silver iodide content than the core. The silver iodide content in the core is more preferably in the range of 10 mol % or more, particularly preferably 20 to 44 mol %. The silver iodide content in the shell is preferably 5 mol % or less.

The core may uniformly contain silver iodide or may have a multiple structure comprising phases having different silver iodide contents. In the latter case, the phase having the highest silver iodide content in the core preferably has a silver iodide content of 5 mol % or more, more preferably 10 mol % or more, and the silver iodide content in the shell is preferably lower than that in the phase having the highest silver iodide content in the core. The term "substantially comprising silver iodobromide" means a material which mainly comprises silver iodobromide but may comprise other components in the amount of not more than 1 mol %.

A further preferred embodiment of the silver halide grains incorporated in the photographic emulsion layer in the silver halide photographic material of the present invention are silver halide grain which exhibit two maximum diffractions, one corresponding to the core portion and the other to the shell portion, and one minimum diffraction interposed therebetween, the diffraction intensity corresponding to the core portion being 1/10 to 3/1 of that corresponding to the shell portion, on a curve of diffraction intensity vs. diffraction angle of the (220) plane of silver halide obtained with $\theta\beta$-rays from Cu at a diffraction angle ($2\theta$) range of 38° to 42° C. Particularly, the diffraction intensity ratio is preferably in the range of 1/5 to 3/1, and more preferably 1/3 to 3/1.

By using silver halide grains having such a double structure, it is made possible to use a silver iodobromide emulsion having a high iodine content without causing any delay in development. Thus, a photographic light-sensitive material which exhibits a excellent graininess even with a small coated amount of silver can be formed.

A further preferred embodiment of the silver halide grains incorporated in the photographic emulsion layer in the silver halide photographic material of the present invention are silver halide grains having an internal core substantially comprising silver bromide and/or silver iodide and a plurality of outer shells substantially comprising silver bromide and/or silver iodobromide, wherein the outermost core has a silver iodide content of 10 mol % or less, a high silver iodide content core having a silver iodide content of 6 mol % or more higher than the outermost core is provided inside the outermost core, and an intermediate core having a middle silver iodide content between that of the two cores is provided between the two cores, the silver iodide content in the intermediate core being 3 mol % or more higher than that in the outermost core, and the silver iodide content in the high silver iodide content core being 3 mol % or more higher than that in the intermediate core. Such silver halides are described in detail in JP-A-61-245151. Such silver halide grains also, exhibit excellent graininess and may be preferably used in the present invention.

A further preferred embodiment of the silver halide grains incorporated in the photographic emulsion layer in the silver halide photographic material of the present invention are silver halide grain having a monodispersibility as defined hereinafter. Specifically, when the value obtained by dividing the standard deviation S of particle diameters by the average particle diameter $\bar{r}$ and multiplying the quotient by 100 (hereinafter referred to as "coefficient of variation") is 16 or less, monodispersibility is obtained, as defined by the following equation:

$$\frac{S}{\bar{r}} \times 100 \leqq 16\%$$

wherein S represents the general standard deviation as used in statistics. The term "particle diameter" as used herein means the diameter in the case of a spherical silver halide grain or the diameter calculated in terms of a circle having the same area as the projected area in the case of silver halide grain having other shapes. The term "average particle diameter" as used herein means the average value of the particle diameters. The average particle diameter $\bar{r}$ can be defined by the following equation:

$$\bar{r} = \frac{\Sigma n_i r_i}{\Sigma n_i}$$

wherein the number of grains having a particle diameter $r_i$ is $n_i$.

Such monodispersed silver halide grains may have a double structure or a multiple structure as earlier described.

Such monodispersed silver halide grains may have any shape such as that of a cube, octahedron, tetradecahedron, sphere, or tablet (tabular).

Such monodispersed silver halide grains exhibit excellent graininess. Monodispersed silver halide grains having a size range giving less light scattering can provide images having excellent sharpness. Such monodispersed silver halide grains are described in detail, for example, in U.S. Pat. Nos. 4,444,877, and 4,446,228, and JP-A-54-48521, JP-A-54-99419, JP-A-56-16124, JP-A-56-78831, JP-A-57-182730, JP-A-58-49938, JP-A-58-37635, JP-A-58-106532, JP-A-58-107530, JP-A-58-126531, JP-A-58-149037, JP-A-59-10947, JP-A-59-29243, JP-A-59-72440, JP-A-59-140443, JP-A-59-148049, JP-A-59-177535, and JP-A-59-152438.

A further preferred embodiment of the silver halide grains incorporated in the photographic light-sensitive material of the present invention are tabular silver halide grain having an aspect ratio of 5 or more. Such silver halide grains give less light scattering and hence high image sharpness, and thus are preferably used in the present invention. Such tabular silver halide grains are described in detail, for example, in U.S. Pat. Nos. 4,434,226, 4,414,310, 4,433,048, and 4,439,520, and British Patent No. 2,112,157.

In order to improve the sharpness of images most effectively, it is preferred that the blue-sensitive layer comprise tabular silver halide grains while the green-sensitive layer and the red-sensitive layer comprise monodispersed silver halide grains. This approach is described in detail in JP-A-63-89839.

The silver halide emulsion layer used in the present invention preferably comprises chemically-sensitized silver halide grains containing metallic impurities other than gold and iridium in a total amount of 3 ppm or less. The use of such a silver halide emulsion makes it possible to easily obtain a high sensitive silver halide photographic material.

The preparation of such a silver halide emulsion having such a small content of metallic impurities other than gold and iridium can be accomplished not only by purifying essential materials for the silver halide emulsion, i.e., water, a hydrophilic colloid such as gelatin, a soluble silver salt such as silver nitrate, and a soluble halogenated alkali such as KBr, KCl, KI, NaBr and NaCl, to remove metallic impurities therefrom but also by preventing metallic impurities from entering into the system from the reactor upon preparation of the emulsion or by using proper technique for adjusting reaction temperature or reaction conditions.

The preparation of the photographic emulsion used in the present invention can be accomplished by any suitable method as described in P. Glafkides, *Chemie et Physique Photographique*, Paul Montel, 1967; G. F. Duffin, *Photographic Emulsion Chemistry*, The Focal Press, 1966; and V. L. Zelikman et al., *Making and Coating Photographic Emulsion*, The Focal Press, 1964. Specifically, the preparation of the silver halide photographic emulsion can be accomplished by any process such as acidic process, neutral process or ammonia process. The process for the reaction of the soluble silver salt with the soluble halide salt can be accomplished by a single jet process, a double jet process, or a combination thereof.

The process for the reaction of the soluble silver salt with the soluble halide salt can be accomplished by a process in which silver halide grains are formed in the presence of excess silver ions (a reverse mixing process).

One form of the double jet process is a controlled double jet process in which the pAg of the liquid in which silver halide is formed is kept constant. This process can provide a silver halide emulsion having a regular crystal structure and a nearly uniform grain size.

Two or more silver halide emulsion which have been separately prepared may be used in admixture.

One suitable silver halide emulsion for use in the present invention includes silver halide grains having on the external surface a crystal plane defined by the mirror index (n n 1) (in which n is a natural number satisfying the relationship $n>2$) as described in Kokai Giho (Japanese Published Technical Report) 86-9598.

Alternatively, silver halide grains having a hollow conduction portion extending from the surface to the interior thereof as described in JP-A-61-75337 are preferably used. Such silver halide grains which have a high specific surface area can easily be sensitized as compared to particulate silver halide grains having the same volume, especially when spectrally sensitized. Such silver halide grains are more effectively used in combination with the present invention.

Composite silver halide grains obtained by the epitaxial growth on host grains of a silver salt having a different composition as described in JP-A-57-133540, JP-A-58-108526, and JP-A-59-162540 are also preferably used in the present invention. Such silver halide grains exhibit high sensitivity and high contrast and are preferably used in the present invention.

A silver halide emulsion which has been grown in the presence of a tetrazaindene as described in JP-A-61-14630 and JP-A-60-122935 has a high silver iodide content and excellent monodispersibility, exhibiting high sensitivity and excellent graininess. Such a silver halide emulsion is also preferably used as a suitable silver halide emulsion for the present invention.

Alternatively, a silver halide emulsion which has been subjected to gold-sulfur sensitization or gold-selenium sensitization in the presence of a nitrogen-containing heterocyclic compound as described in JP-A-58-126526 exhibits less fog and higher sensitivity, and is therefore useful as a suitable silver halide emulsion in the present invention.

Further, slightly rounded cubic or tetradecahedral silver halide crystals as described in JP-A-59-149345 and JP-A-59-149344 can provide high sensitivity and therefore can also be used as preferred silver halide grains for the present invention.

In the process of formation or physical ripening of silver halide grains, a cadmium salt, a zinc salt, a lead salt, a thallium salt, an iridium salt or a complex salt thereof, a rhodium salt or a complex salt thereof, or an iron salt or a complex salt thereof may be coexist.

In particular, a silver halide emulsion which has been formed in the presence of iridium provides high sensitivity as described in JP-B-43-4935 and JP-B-45-32738. Such a silver halide emulsion may be preferably used in the present invention.

After being precipitated or physically ripened, the photographic emulsion are normally subjected to removal of soluble salts. To this end, a conventional noodle washing process in which gelatin is gelled may be used. Alternatively, a conventional precipitation (or flocculation) process using an inorganic salt comprising a polyvalent anion (for example, sodium sulfate), an anionic surface active agent, an anionic polymer (for example, polystyrenesulfonic acid) or a gelatin derivative (for example, aliphatic acylated gelatin or aromatic acylated gelatin, aromatic carbamoylated gelatin) may be used.

The photographic emulsion used in the present invention may be optionally subjected to spectral sensitization with a methine dye or the like. Examples of such a dye include a cyanine dye, a merocyanine dye, a complex cyanine dye, a complex merocyanine dye, a holopolar cyanine dye, a hemicyanine dye, a styryl dye and a hemioxonol dye. Particularly preferred dyes are a cyanine dye, a merocyanine dye and a complex merocyanine dye. Any of nuclei which are conventionally used as basic heterocyclic nucleus for cyanine dye can be applied to these dyes. Examples of suitable nuclei which can be applied to these dyes include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei obtained by fusion of alicyclic hydrocarbon rings to these nuclei or nuclei obtained by fusion of aromatic hydrocarbon rings to these nuclei, for example, an indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may be substituted on carbon atoms.

Examples of suitable nuclei which can be applied to merocyanine dyes or complex merocyanine dyes include those having a ketomethylene structure such as a pyrazoline-5-one nucleus, thiohydantoin nucleus, 2-thiooxazolidine-2,4-dione nucleus, thiazolidine-2,4-dione nucleus, rhodanine nucleus, thiobarbituric acid nucleus and other 5-membered or 6-membered heterocyclic nucleus.

Examples of useful sensitizing dyes include those described in German Patent No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Patent No. 1,242,588, JP-B-44-14030, and JP-B-52-24844.

These sensitizing dyes may be used singly or in combination. Such a combination of sensitizing dyes is often used for the purpose of supersensitization. Typical examples of such a combination of sensitizing dyes are described in U.S. Pat. Nos. 2,688,545, 2,977,299, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents Nos. 1,344,281, and 1,507,803, JP-B-43-4936, JP-B-53-12375, JP-A-52-110618, and JP-A-52-109925.

The photographic emulsion may comprise a dye which itself does not have a spectral sensitizing effect or a substance which does not substantially absorb visible light but exhibits a supersensitizing effect together with the above described sensitizing dyes. Examples of such a dye or substance which may be incorporated in the emulsion include aminostyryl compounds substituted by nitrogen-containing heterocyclic groups as described in, for example, U.S. Pat. Nos. 2,933,390 and 3,635,721, aromatic organic acid-formaldehyde condensates as described in U.S. Pat. No. 3,743,510 and cadmium salts and azaindene compounds. Combinations as described in U.S. Pat. Nos. 3,615,613, 3,615,641, 3,617,295 and 3,635,721 are particularly useful.

The silver halide emulsion used in the photographic light-sensitive material of the present invention may be subjected to spectral sensitization in the manner as described above to increase the sensitivity to visible light in the desired wavelength range. In order to minimize the deterioration in the properties due to natural radiation, the sensitivity of the silver halide emulsion to radiation may preferably be as low as possible. A study made by the inventors showed that the sensitivity of a silver halide emulsion to radiation has a good correlation with inherent sensitivity and does not necessarily correlate with spectral sensitivity. Therefore, in order to minimize the deterioration in the properties due to natural radiation while maintaining high light sensitivity, an emulsion having high spectral sensitivity but a low inherent sensitivity may preferably be used. To this end, the above described super-sensitizers which increase only the spectral sensitivity without changing the inherent sensitivity are particularly preferred. Alternatively, a sensitizing dye may be incorporated at a high loading amount (as much as possible) so long as the spectral sensitivity is not excessively lowered. Thus, an inherent desensitization can be effected to lower the inherent sensitivity. Furthermore, tabular silver halide grains having an aspect ratio of 5 or more which exhibit a high efficiency of spectral sensitization with a sensitizing dye may preferably be used.

The preparation of tabular silver halide grains can be easily accomplished by any suitable method as described in Gutoff, *Photographic Science and Engineering*, Vol. 14, pp. 248–257, 1970, U.S. Pat. Nos. 4,434,226, 4,414,310, 4,433,048, and 4,439,520, and British Patent No. 2,112,157.

Moreover, an emulsion which has been subjected to supersensitization as described in JP-A-62-89952 is preferably employed in the present invention.

In the present invention, when the silver coated amount is higher than 13 g/m$^2$, it is difficult to avoid the influence of natural radiation even if the silver halide grains according to the present invention are used.

For the purpose of analysis of the silver content in a photographic light-sensitive material, any known method can be employed. For example, an elementary analysis using fluorescent X-rays is conveniently used.

The photographic light-sensitive material of the present invention preferably has a specific photographic sensitivity of 400 or more, more preferably 800 or more.

The definition and the method for measurement of specific photographic sensitivity are described in JP-A-63-100453, page 3 right upper column to page 5 left lower column.

Known photographic additives which can be used in the present invention are described in *Research Disclosure,* No. 17643, (December, 1978) and ibid., No. 18716 (November, 1979) and relevant items thereof are summarized in the table shown below.

| | Kind of Additives | RD 17643 | RD 18716 |
|---|---|---|---|
| 1. | Chemical Sensitizers | Page 23 | Page 648, right column |
| 2. | Sensitivity Increasing Agents | | Page 648, right column |
| 3. | Spectral Sensitizers and Supersensitizers | Pages 23 to 24 | Page 648, right column to page 649, right column |
| 4. | Whitening Agents | Page 24 | |
| 5. | Antifoggants and Stabilizers | Pages 24 to 25 | Page 649, right column |
| 6. | Light-Absorbers, Filter Dyes and Ultraviolet Ray Absorbers | Pages 25 to 26 | Page 649, right column to page 650, left column |
| 7. | Antistaining Agents | Page 25, right column | Page 650, left column to right column |
| 8. | Dye Image Stabilizers | Page 25 | |
| 9. | Hardeners | Page 26 | Page 651, left column |
| 10. | Binders | Page 26 | Page 651, left column |
| 11. | Plasticizers and Lubricants | Page 27 | Page 650, right column |
| 12. | Coating Aids and Surfactants | Pages 26 to 27 | Page 650, right column |
| 13. | Antistatic Agents | Page 27 | Page 650, right column |

Further, in order to prevent degradation of photographic properties due to formaldehyde gas, it is preferred to add a compound capable of reacting with formaldehyde gas to fix it (as described in U.S. Pat. Nos. 4,411,987 and 4,435,503) to the photographic light-sensitive material.

In the present invention, various color couplers can be employed and specific examples thereof are described in the patents cited in *Research Disclosure,* No. 17643, "VII-C" to "VII-G".

As yellow couplers used in the present invention, for example, those as described in U.S. Pat. Nos. 3,933,501, 4,022,620, 4,326,024 and 4,401,752, JP-B-58-10739, British Pat. Nos. 1,425,020 and 1,476,760, U.S: Pat. Nos. 3,973,968, 4,314,023 and 4,511,649, and European Patent No. 249,473A are preferred.

As magenta couplers used in the present invention, 5-pyrazolone type and pyrazoloazole type compounds are preferred. Magenta couplers as described in U.S. Pat. Nos. 4,310,619 and 4,351,897, European Patent No. 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630 are particularly preferred.

As cyan couplers used in the present invention, phenol type and naphthol type couplers are exemplified. Cyan couplers as described in U.S. Pat. Nos. 4,052,212, 4,146,396, 4,228,233, 4296,200, 2,369,929, 2,801,171, 2,772,162, 2,895,826, 3,772,002, 3,758,308, 4,334,011 and 4,327,173, West German Patent Application (OLS) No. 3,329,729, European Patent Nos. 121,365A and 249,453A, U.S. Pat. Nos. 3,446,622, 4,333,999, 4,451,559, 4,427,767, 4,690,889, 4,254,212 and 4,296,199, and JP-A-61-42658 are preferred.

As colored couplers for correcting undesirable absorptions of dyes formed, those as described in *Research Disclosure,* No. 17643, "VII-G", U.S. Patent 4,163,670, JP-B-57-39413, U.S. Pat. Nos. 4,004,929 and 4,138,258, and British Patent No. 1,146,368 are preferably employed.

As couplers capable of forming appropriately diffusible dyes, those as described in U.S. Pat. No. 4,366,237, British Patent No. 2,125,570, European Patent No. 96,570, and West German Patent Application (OLS) No. 3,234,533 are preferably employed.

Typical examples of useful polymerized dye forming couplers are described in U.S. Pat. Nos. 3,451,820, 4,080,211, 4,367,282, 4,409,320 and 4,576,910, and British Patent No. 2,102,173.

Couplers capable of releasing a photographically useful moiety during the course of coupling can also be employed preferably in the present invention. As DIR couplers capable of releasing a development inhibitor, those as described in the patents cited in *Research Disclosure,* No. 17643, "VII-F" described above, JP-A-57-151944, JP-A-57-154234 and JP-A-60-184248, and U.S. Pat. No. 4,248,962 are preferred.

As couplers which imagewise release a nucleating agent or a development accelerator at the time of development, those as described in British Patent Nos. 2,097,140 and 2,131,188, JP-A-59-157638, and JP-A-59-170840 are preferred.

Furthermore, competing couplers such as those described in U.S. Pat. No. 4,130,427; polyequivalent couplers such as those described in U.S. Pat. Nos. 4,283,472, 4,338,393 and 4,310,618; DIR redox compound releasing couplers or DIR coupler releasing couplers or DIR coupler releasing redox compound or DIR redox compound releasing redox compound such as those described in JP-A-60-185950 and JP-A-62-24252; couplers capable of releasing a dye which turns to a colored form after being released such as those described in European Patent No. 173,302A; bleach accelerating agent releasing couplers such as those described in *Research Disclosure* No. 11449, ibid. No. 24141 and JP-A-61-201247; and ligand releasing couplers such as those described in U.S. Pat. No. 4,553,477, and the like may be employed in the photographic light-sensitive material of the present invention.

The couplers which can be used in the present invention can be introduced into the photographic light-sensitive material according to various known dispersing methods.

Examples of suitable organic solvent having a high boiling point which can be employed in an oil droplet-in-water type dispersing method are described, for example, in U.S. Pat. No. 2,322,027.

Specific examples of organic solvents having a high boiling point (a boiling point not less than 175° C. at normal pressure) which can be employed in the oil droplet-in-water type dispersing method include phthalic acid esters (for example, dibutyl phthalate, dicyclohexyl phthalate, di-2-ethylhexyl phthalate, didecyl phthalate, bis(2,4-di-tert-amylphenyl)phthalate, bis(2,4-di-tert-amylphenyl)isophthalate, or bis(1,1-diethyl propyl)phthalate, phosphoric acid or phosphonic acid esters (for example, triphenyl phosphate, tricresyl phosphate, 2 ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenylphosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), alcohols or phenols (for example, isostearyl alcohol, or 2,4-di-tertamylphenol), aliphatic carboxylic acid esters (for example, bis(2-ethylhexyl)-sebacate, dioctyl azelate, glycerol tributyrate, isostearyl lactate, or trioctyl citrate), aniline derivatives (for example, N,N-dibutyl-2-butoxy-5-tert-octylaniline), and hydrocarbons (for example, paraffin, dodecylbenzene, or diisopropylnaphthalene).

Further, an organic solvent having a boiling point of at least about 30° C. and preferably having a boiling point above 50° C. but below about 160° C. can be used as an auxiliary solvent. Typical examples of auxiliary solvents include ethyl acetate, butyl acetate, ethyl propionate, methyl ethyl ketone, cyclohexanone, 2-ethoxyethyl acetate, or dimethylformamide.

The processes and effects of latex dispersing methods and the specific examples of latexes for loading are described, for example, in U.S. Pat. No. 4,199,363, West German Patent Application (OLS) Nos. 2,541,274 and 2,541,230.

Suitable supports which can be used in the present invention are described, for example, in *Research Disclosure,* No. 17643, page 28 and ibid., No. 18716, page 647, right column to page 648, left column, as mentioned above.

The color photographic light-sensitive material according to the present invention can be subjected to development processing in a conventional manner as described in *Research Disclosure,* No. 17643, pages 28 to 29 and ibid., No. 18716, page 651, left column to right column, earlier mentioned.

The color developing solution which can be used in development processing of the color photographic light-sensitive material according to the present invention is an alkaline aqueous solution preferably containing an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4 -amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-N-β-methoxyethylaniline, or sulfate, hydrochloride or p-toluenesulfonate thereof.

Two or more kinds of color developing agents may be employed in a combination thereof, depending on the purpose.

The color developing solution can ordinarily contain pH buffering agents, such as carbonates, borates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, phenylsemicarbazides, triethanolamine, catechol sulfonic acids, or triethylenediamine(1,4-diazabicyclo[2,2,2]octane); organic solvents such as ethylene glycol, or diethylene glycol; development accelerators such as benzyl alcohol, polyethylene glycol, quaternary ammonium salts, or amines; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and salts thereof.

In the case of conducting reversal processing, color development is usually conducted after black-and-white development. In a black-and-white developing solution, known black-and-white developing agents, for example, dihydroxybenzenes such as hydroquinone, 3-pyrazolidones such as 1-pheyl 3-pyrazolidone, or aminophenols such as N-methyl-p-aminophenol may be employed individually or in a combination.

All amounts are as conventionally used in the art.

The pH of the color developing solution or the black-and-white developing solution is usually in a range from 9 to 12. Further, the amount of replenisher for the developing solution can be varied depending on the color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenisher, it is preferred to prevent evaporation and aerial oxidation of the processing solution by means of reducing the area of a processing tank which is in contact with the air. Further, the amount of replenisher can be reduced using a means which restrains accumulation of bromide ion in the developing solution.

The processing time of the color development is usually selected in a range from 2 minutes to 5 minutes. However, it is possible to reduce the processing time by performing the color development at high temperature and high pH using a high concentration of color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein after a bleach processing a bleach-fix processing is conducted may be employed. Moreover, it may be appropriate, depending on the purpose, to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(IV), or copper(II); peracids; quinones; or nitro compounds. Representative examples of the bleaching agents include ferricyanides; dichromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions..

The pH of the bleaching solution or bleach-fixing solution containing an iron(III) complex salt of aminopolycarboxylic acid is usually in a range from 5.5 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and Research Disclosure, No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Pat. No. 3,706,561; iodides as described, for example, in West German Patent No. 1,127,715 and JP-A-58-16235; polyoxyethylene compounds as described, for example, in West German Patents 966,410 and 2,748,430; polyamine compounds as described, for example, in JP-B-45-8836; compounds as described, for example, in JP-A-49-42434, JP-A-49-59644, JP-A-53-94927, JP-A-54-35727, JP-A-55-26506, and JP-A-58-163940; and bromide ions. Of these compounds, compounds having a mercapto group or a disulfide bond are preferred in view of their strong bleach accelerating effects. In particular, the compounds as described in U.S. Pat. No. 3,893,858, West German Patent No. 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photography are subjected to bleach-fix processing.

As fixing agents which can be employed in the fixing solution or bleach-fixing solution, thiosulfates, thiocyanate, thioether compounds, thioureas, or a large amount of iodide are exemplified. Of these compounds, thiosulfates are generally employed. In particular, ammonium thiosulfate is most widely employed. It is preferred to use sulfites, bisulfites or carbonylbisulfite adducts as preservatives in the bleach-fixing solution.

Amounts for the bleach, bix, etc., are as conventionally used in the art.

After a desilvering step, the silver halide color photographic material according to the present invention is generally subjected to a water washing step and/or a stabilizing step.

The amount of water required for the water washing step may be set in a wide range depending on the characteristics of the photographic light-sensitive materials (due to elements used therein, for example, couplers, etc.), uses thereof, temperature of washing water, the number of water washing tanks (stages), the replenishment system such as countercurrent or co-current, or other various conditions. The relationship between the number of water washing tanks and the amount of water in a multi-stage countercurrent system can be determined based on the method as described in *Journal of the Society of Motion Picture and Television Engineers*, Vol. 64, pages 48 to 253 (May, 1955).

According to the multi-stage countercurrent system described in the above literature, the amount of water for washing can be significantly reduced. However, an increase in the residence time of the water in a tank causes propagation of bacteria and some problems such as adhesion of floatage formed on the photographic materials occur. In the method of processing the silver halide color photographic material according to the present invention, the method for reducing amounts of calcium ions and magnesium ions as described in JP-A-62-288838 can be particularly effectively employed in order to solve such problems. Further, sterilizers, for example, isothiazolone compounds as described in JP-A-57-8542, thiabendazole, chlorine type sterilizers such as sodium chloroisocyanurate, benzotriazoles, and sterilizers as described in Hiroshi Horiguchi, *Bokin-Bobai No Kaqaku, Biseibutsu No Mekkin-, Sakkin-, Bobai-Gijutsu*, edited by Eiseigijutsu Kai, and *Bokin-Bobaizai Jiten*, edited by Nippon Bokin-Bobai Gakkai can be employed.

The pH of the washing water used in the processing of the photographic light-sensitive materials according to the present invention is usually from 4 to 9, preferably from 5 to 8. Temperature of washing water and time for a water washing step can be variously set depending on characteristics or uses of photographic light-sensitive materials. However, it is general to select a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any known methods as described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formalin and a surface active agent, which is employed as a final bath in the processing of color photographic light-sensitive materials for photographing. To such a stabilizing bath, various chelating agents and antimolds may also be added.

Overflow solutions resulted from replenishment of the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. No. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example in JP-A-56-64339, JP-A-57-144547, and JP-A-58-115438.

In the present invention, the various other processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve an improvement in image quality and to maintain stability of the processing solutions.

Further, for the purpose of saving silver employed in the color photographic light-sensitive material, the photographic processing may be conducted utilizing color intensification using cobalt or hydrogen peroxide as described in West German Patent No. 2,226,770 or U.S. Pat. No. 3,674,499.

The present invention can be applied to various color photographic light-sensitive materials, and typical examples thereof include color negative films for the general use or cinematography, color reversal films for slides or television, and black-and-white negative films.

Moreover, the silver halide color photographic material of the present invention can be applied to heat-developable light-sensitive materials as described, for example, in U.S. Pat. No. 4,500,626, JP-A-60-133449, JP-A-59-218443, JP-A-61-238056 and European Patent No. 210,660A2.

The present invention will now be illustrated in greater detail with reference to the following Examples, but the present invention is not to be construed as being limited thereto. Unless otherwise indicated, all parts, percents and ratios are by weight.

EXAMPLES

Photographic emulsions according to the present invention and photographic emulsions for comparison were prepared as follows.

(1) Preparation of EM-1 (emulsion of the present invention)

Solution 1-2 was added to Solution 1-1 kept at 70° C. with vigorous stirring. Solutions 1-3*a* and 1-3*b* were added simultaneously to the mixture over a period of 45 seconds. Solutions 1-4*a* and 1-4*b* were simultaneously added thereto over a period of 45 minutes. Solutions 1-5*a* and 1-5*b* were then added simultaneously over a period of 30 minutes. After the resulting solution system was adjusted so as to having pBr of 1.7 and a temperature of 75° C., Solution 1-6 was added thereto. Then, Solutions 1-7*a* and 1-7*b* were added thereto simultaneously over a period of 5 minutes.

| | |
|---|---|
| Solution 1-1 Formulation | |
| Inert gelatin | 18.8 g |
| Water | 630 ml |
| Solution 1-2 Formulation | |
| Potassium bromide | 4.1 g |
| Water | 15 ml |
| Solution 1-3a Formulation | |
| Potassium bromide | 1.93 g |
| Water | 19.2 ml |
| Solution 1-3b Formulation | |
| Silver nitrate | 2.70 |
| Water | 27.2 ml |
| Solution 1-4a Formulation | |
| Potassium bromide | 39.4 g |
| Potassium iodide | 3.93 g |
| Water | 203 ml |
| $HO—(CH_2)_2—S—(CH_2)_2—S—(CH_2)_2—OH$ | 0.20 g |
| Solution 1-4b Formulation | |
| Silver nitrate | 61.4 g |
| Water | 233 ml |
| Solution 1-5a Formulation | |
| Potassium bromide | 22.5 g |
| Potassium iodide | 0.0979 g |
| $HO—(CH_2)_2—S—(CH_2)_2—S—(CH_2)_2—OH$ | 0.0559 g |
| Water | 111 ml |
| Solution 1-5b Formulation | |
| Silver nitrate | 33.4 g |
| Water | 121 ml |
| Solution 1-6 Formulation | |
| Potassium thiocyanate | 1.42 g |
| Water | 15 ml |
| Solution 1-7a Formulation | |
| Potassium iodide | 3.41 g |
| Potassium bromide | 0.19 g |
| Water | 60 ml |
| Solution 1-7b Formulation | |
| Silver nitrate | 7.07 g |
| Water | 60 ml |

After the resulting emulsion was desalted in a conventional manner, inert gelatin was added thereto. The emulsion was then subjected to chemical sensitization to the optimum degree using potassium chloroaurate and sodium thiosulfate. The thus prepared silver halide emulsion was designated as EM-1.

(2) Preparation of EM-2 (emulsion of the present invention):

Silver halide emulsion EM-2 was prepared in the same manner as described for EM-1, except for changing the time of adding Solutions 1-7*a* and 1-7*b* to 2 minutes 30 seconds.

(3) Preparation of EM-3 (emulsion of the present invention):

An emulsion was prepared in the same manner as described for EM-1, except for changing the composition of Solution 1-7*a* to that of Solution 3-1, followed by subjecting the chemical sensitization to the optimum degree. The resulting emulsion was designated as EM-3.

| Solution 3-1 Formulation | |
|---|---|
| Potassium iodide | 1.50 g |
| Potassium bromide | 1.56 g |
| Water | 60 ml |

(4) Preparation of EM-4 (comparative emulsion):

An emulsion was prepared in the same manner as described for EM-1, except for changing the composition of Solution 1-7*a* to that of Solution 4-1, followed by subjecting to chemical sensitization to the optimum degree. The resulting emulsion was designated as EM-4.

| Solution 4-1 Formulation | |
|---|---|
| Potassium iodide | 0.33 g |
| Potassium bromide | 2.40 g |
| Water | 60 ml |

(5) Preparation of EM-5 (comparative emulsion):

An emulsion was prepared in the same manner as described for EM-1, except that the addition of Solution 1-6, Solution 1-7*a* and Solution 1-7*b* was not conducted, that the amounts of Solution 1-5*a* and Solution 1-5b were increased 21%, and that the addition time thereof was prolonged to 36 minutes, followed by subjecting to chemical sensitization to the optimum degree. The resulting emulsion was designated as EM-5.

(6) Preparation of EM-6 (emulsion of the present invention):

An emulsion was prepared in the same manner as described for EM-1, except for changing the compositions of Solution 1-4*a* and Solution 1-5a to those of Solution 6-1 and Solution 6-2, respectively, followed by subjecting to chemical sensitization to the optimum degree. The resulting emulsion was designated as EM-6.

| Solution 6-1 Formulation | |
|---|---|
| Potassium bromide | 42.2 g |
| Water | 203 ml |
| $HO—(CH_2)_2—S—(CH_2)_2—S—(CH_2)_2—OH$ | 0.05 g |
| Solution 6-2 Formulation | |
| Potassium bromide | 22.6 g |
| $HO—(CH_2)_2—S—(CH_2)_2—S—(CH_2)_2—OH$ | 0.03 g |

-continued

| | |
|---|---|
| Water | 111 ml |

With EM-1 to EM-6, the average iodine content ($\overline{Io}$PS/ )) of the outermost layer, the average iodine content ($\bar{I}_w$) of the whole silver halide grain and the average iodine content ($\bar{I}_A$) in a minute region in the direction perpendicular to the two main planes facing each other extending from the surface of the grain to the interior thereof were measured by means of XPS analysis, fluorescent X-ray analysis and electron microscopic analysis, respectively. In each of EM-1 to EM-6, the ratio of a projected area of silver halide grains having a diameter corresponding to a circle of at least 0.4 μm occupied over 50% of the total projected area. The average aspect ratio of each emulsion was determined. The results are shown in Table 1.

TABLE 1

| Emulsion | $\overline{Io(XPS)}$ (mol %) | $\bar{I}w$ (mol %) | Number average of Diameter Corresponding Circle (μm) | Average Aspect Ratio |
|---|---|---|---|---|
| EM-1 (Present Invention) | 10.5 | 7.3 | 2.80 | 7.2 |
| EM-2 (Present Invention) | 10.9 | 7.3 | 2.77 | 7.2 |
| EM-3 (Present Invention) | 6.7 | 5.4 | 2.78 | 7.0 |
| EM-4 (Comparison) | 5.0 | 4.3 | 2.79 | 7.1 |
| EM-5 (Comparison) | 3.2 | 4.0 | 2.83 | 7.3 |
| EM-6 (Present Invention) | 9.2 | 3.3 | 2.84 | 7.3 |

As the result of the electron microscopic analysis it was formed that the iodine composition in a layer in the direction parallel to the main planes was uniform in EM-6 and a minute region having a higher average iodine content than the average iodine content $\bar{I}_A$ in a minute region at the edge of the grains was present inside the edge of grains in each of EM-1 to EM-5.

The XPS measurement was conducted by means of an ESCA-750 unit manufactured by Shimazu Seisakusho Ltd. using Mg-Kα rays (acceleration voltage 8 KV, electric current: 30 mA) as exciting X-rays, peak areas corresponding to I-$3d_{5/2}$ and Ag-$3d_{5/2}$ were determined. From the intensity ratio thereof, the average silver iodide content in the surface portion of the silver halide grain was obtained.

The chemical sensitization of EM-1 to EM-6 was performed so that the optimum sensitivity was obtained at an exposure of 1/100 sec.

Sample 1-1

On a cellulose triacetate film support provided with a subbing layer, each layer having the composition shown below was coated to prepare a multilayer color photographic light-sensitive material which was designated as Sample 101.

Composition of light-sensitive layer

The coated amount of each component is represented in g/m². The coated amount of silver halide and colloidal silver are presented in terms of amount of silver. The coated amount of sensitizing dye is represented as a molar amount per 1 mol of silver halide incorporated into the same layer.

| | |
|---|---|
| First Layer: Antihalation Layer | |
| Black colloidal silver | 0.18 (as silver) |
| Gelatin | 1.40 |
| Second Layer: Intermediate Layer | |
| 2,5-Di-tert-pentadecyl hydroquinone | 0.18 |
| EX-1 | 0.07 |
| EX-3 | 0.02 |
| EX-13 | 0.004 |
| U-1 | 0.08 |
| U-2 | 0.08 |
| HBS-1 | 0.10 |
| HBS-2 | 0.02 |
| Gelatin | 1.04 |
| Third Layer: First Red-Sensitive Emulsion Layer | |
| Silver iodobromide emulsion | 0.50 (as silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 0.87 |
| Fourth Layer: Second Red-Sensitive Emulsion Layer | |
| Silver iodobromide emulsion | 0.97 (as silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.300 |
| EX-3 | 0.050 |
| EX-10 | 0.015 |
| HBS-2 | 0.050 |
| Gelatin | 1.19 |
| Fifth Layer: Third Red-Sensitive Emulsion Layer | |
| Silver iodobromide emulsion EM-4 | 1.46 (as silver) |
| Sensitizing dye IX | $8.6 \times 10^{-5}$ |
| Sensitizing dye II | $2.2 \times 10^{-5}$ |
| Sensitizing dye III | $3.8 \times 10^{-4}$ |
| Sensitizing dye IV | $5.0 \times 10^{-5}$ |
| EX-5 | 0.050 |
| EX-3 | 0.055 |
| EX-4 | 0.200 |
| HBS-1 | 0.32 |
| Gelatin | 1.56 |
| Sixth Layer: Intermediate Layer | |
| Gelatin | 1.06 |
| Seventh Layer: First Green-Sensitive Emulsion Layer | |
| Silver iodobromide emulsion | 0.31 (as silver) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| Gelatin | 0.64 |
| Eighth Layer: Second Green-Sensitive Emulsion Layer | |
| Silver iodobromide emulsion | 0.72 (as silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-12 | 0.018 |
| EX-8 | 0.010 |
| EX-1 | 0.008 |
| EX-7 | 0.012 |
| HBS-1 | 0.60 |
| Gelatin | 0.73 |
| Ninth Layer: Third Green-Sensitive Emulsion Layer | |
| Silver iodobromide emulsion EM-4 | 1.66 (as silver) |
| Sensitizing dye V | $4.7 \times 10^{-5}$ |
| Sensitizing dye VI | $1.1 \times 10^{-4}$ |
| Sensitizing dye VII | $4.1 \times 10^{-4}$ |
| EX-6 | 0.065 |
| EX-12 | 0.030 |
| EX-1 | 0.025 |
| HBS-2 | 0.55 |
| Gelatin | 1.54 |
| Tenth Layer: Yellow Filter Layer | |
| A-3 | 0.03 |
| A-2 | 0.05 |
| A-1 | 0.08 |
| HBS-1 | 0.03 |
| Gelatin | 0.95 |
| Eleventh Layer: First Blue-Sensitive Emulsion Layer | |
| Silver iodobromide emulsion | 0.22 (as silver) |
| Sensitizing dye VIII | $3.5 \times 10^{-4}$ |
| EX-9 | 0.85 |
| EX-8 | 0.12 |
| HBS-1 | 0.28 |
| Gelatin | 1.10 |
| Twelfth Layer: Second Blue-Sensitive Emulsion Layer | |
| Silver iodobromide emulsion | 0.45 (as silver) |
| Sensitizing dye VIII | $2.1 \times 10^{-4}$ |
| EX-11 | 0.10 |
| EX-14 | 0.10 |
| EX-15 | 0.015 |
| HBS-1 | 0.03 |
| Gelatin | 0.78 |
| Thirteenth Layer: Third Blue Sensitive Emulsion Layer | |
| Silver iodobromide emulsion EM-4 | 0.77 (as silver) |
| Sensitizing dye VIII | $6.0 \times 10^{-4}$ |
| EX-11 | 0.10 |
| EX-14 | 0.10 |
| HBS-1 | 0.07 |
| Gelatin | 0.69 |
| Fourteen Layer: First Protective Layer | |
| Silver iodobromide emulsion (silver iodide content: 1 mol %; average particle diameter: 0.07 μm) | 0.10 (as silver) |
| U-1 | 0.11 |
| U-2 | 0.17 |
| HBS-1 | 0.90 |
| Gelatin | 0.73 |
| Fifteenth Layer: Second Protective Layer | |
| Polymethyl acrylate particle (diameter: about 1.5 μm) | 0.54 |
| S-1 | 0.05 |
| S-2 | 0.20 |
| Gelatin | 0.72 |

Besides the above described components, a gelatin hardener H-1, a surface active agent (0.5 g/m$^2$), Compound S-3 and Compound S-4 were incorporated into each layer.

The properties of the silver iodobromide emulsions used are shown in Table 2.

TABLE 2

| Layer | A* | B* | C* | D* | E* | F* | G* |
|---|---|---|---|---|---|---|---|
| 3 | 0.6 | 21 | 6.0 | Internal high AgI type | ½ | Octa-hedron | — |
| 4 | 0.8 | 38 | 8.0 | Internal high AgI type | ½ | Tabular | 3.2 |
| 7 | 0.6 | 21 | 6.0 | Internal high AgI type | ½ | Octa-hedron | — |
| 8 | 0.7 | 40 | 9.0 | Internal high AgI type | ½ | Tabular | 3.2 |
| 11 | 0.6 | 21 | 6.0 | Internal high AgI type | ½ | Octa-hedron | — |
| 12 | 0.8 | 40 | 10.0 | Internal high | ½ | Tabular | 3.5 |

TABLE 2-continued

| Layer | A* | B* | C* | D* | E* | F* | G* |
|---|---|---|---|---|---|---|---|
| | | | | AgI type | | | |

*A: Average grain diameter (diameter corresponding to a sphere) (μm)
B: Coefficient of variation of diameter corresponding to a sphere (%)
C: Average silver iodide content (mol %)
D: Structure
E: Core/shell ratio (weight)
F: Shape
G: Diameter/thickness ratio The structural formula or name of the compounds used in this example will be set forth below.

U-1

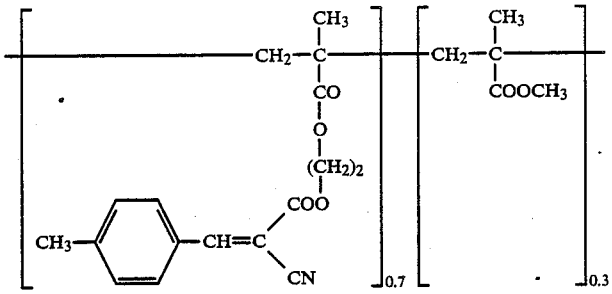

U-2

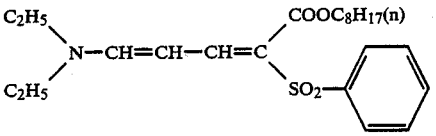

EX-1

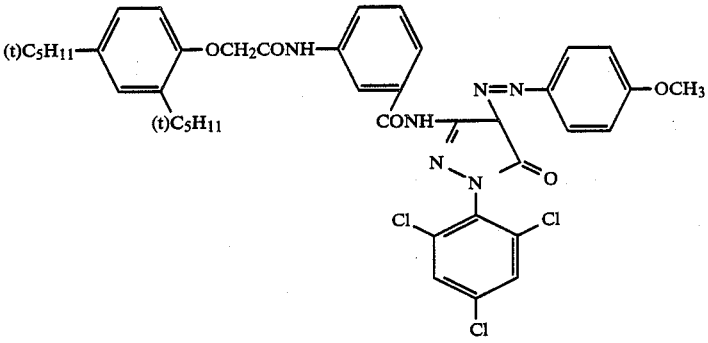

EX-2

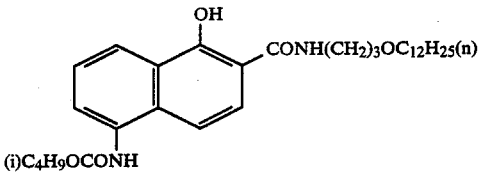

EX-3

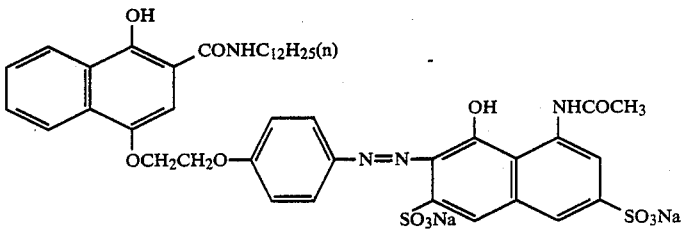

EX-4

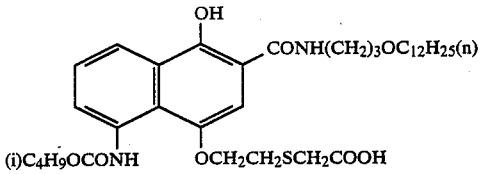

-continued
EX-5
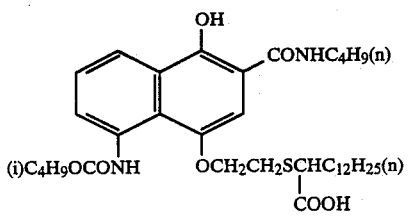
EX-6
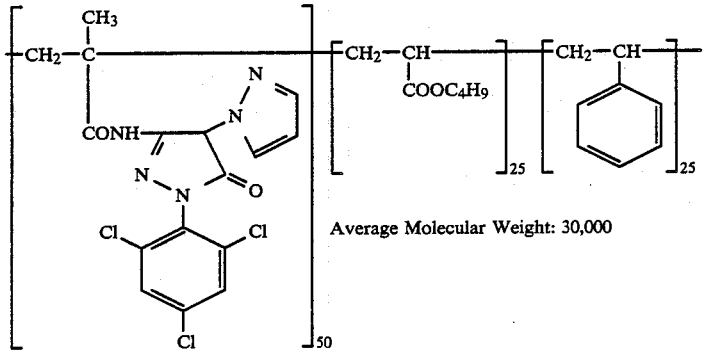
EX-7
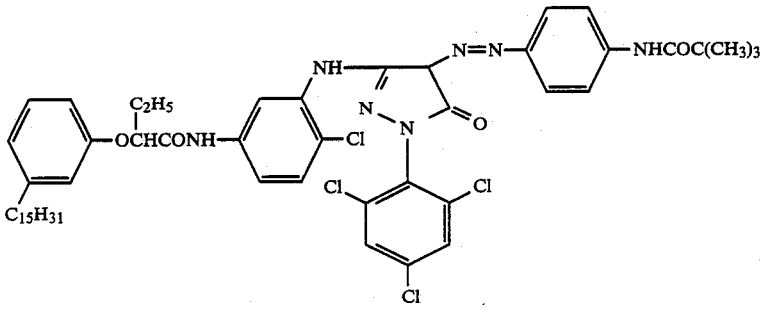
EX-8
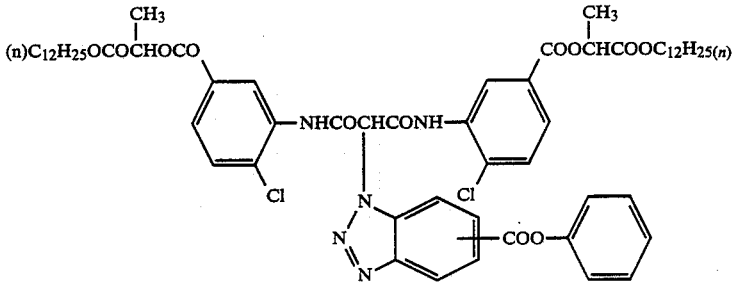
EX-9
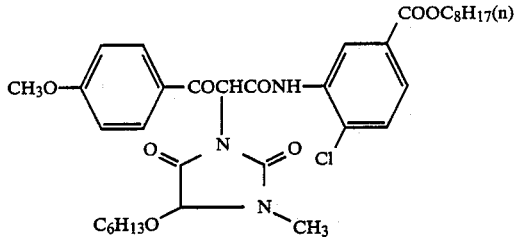

-continued

EX-10

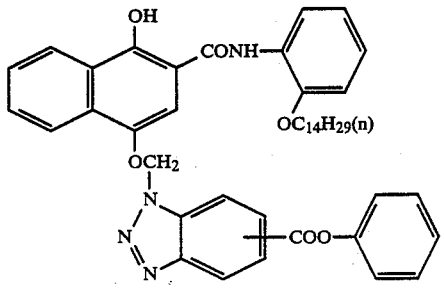

EX-11

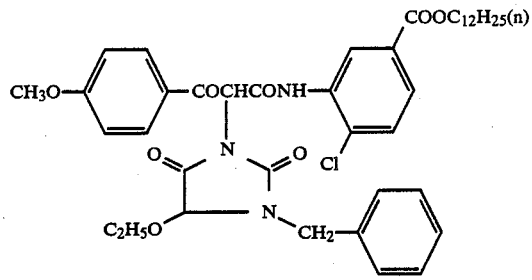

EX-12

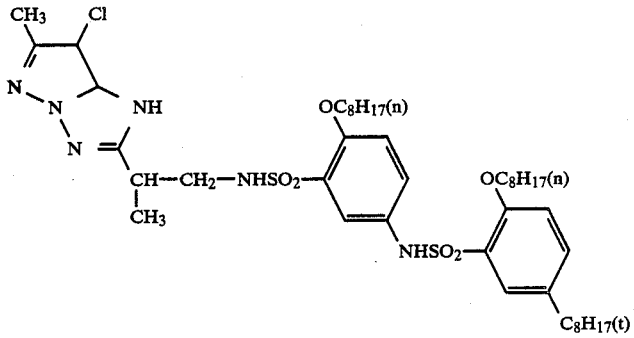

EX-13

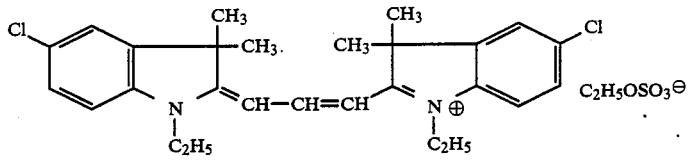

S-1

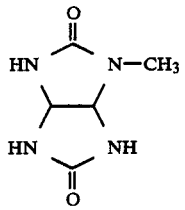

S-2

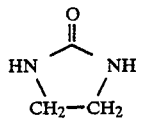

Sample 102

Sample 102 was prepared in the same manner as described for Sample 101 except that an equimolar amount of EM-1 was employed in place of EM-4 used in the fifth layer, the ninth layer and the thirteenth layer of Sample 101.

Samples 103 to 108

Samples 103 to 105 were prepared in the same manner as described for Sample 101 except that the ratio of gold amount/silver amount was changed as shown in Table 3 below.

Samples 106 to 108 were prepared in the same manner as described for Sample 102 except that the ratio of gold amount/silver amount was changed as shown in Table 3 below.

TABLE 3

| Sample No. | Gold/Silver Ratio 3rd Layer | 4th Layer | 5th Layer | 7th Layer | 8th Layer | 9th Layer |
|---|---|---|---|---|---|---|
| 101 (Comparison) | $16 \times 10^{-6}$ | $14 \times 10^{-6}$ | $11.5 \times 10^{-6}$ | $16 \times 10^{-6}$ | $15 \times 10^{-6}$ | $12 \times 10^{-6}$ |
| 102 (Comparison) | $16 \times 10^{-6}$ | $14 \times 10^{-6}$ | $11.5 \times 10^{-6}$ | $16 \times 10^{-6}$ | $15 \times 10^{-6}$ | $12 \times 10^{-6}$ |
| 103 (Comparison) | $10.2 \times 10^{-6}$ | $8.4 \times 10^{-6}$ | $6.2 \times 10^{-6}$ | $10.2 \times 10^{-6}$ | $9.0 \times 10^{-6}$ | $6.4 \times 10^{-6}$ |
| 104 (Comparison) | $7.8 \times 10^{-6}$ | $6.6 \times 10^{-6}$ | $4.5 \times 10^{-6}$ | $7.8 \times 10^{-6}$ | $6.9 \times 10^{-6}$ | $4.8 \times 10^{-6}$ |
| 105 (Comparison) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |
| 106 (Present Invention) | $10.2 \times 10^{-6}$ | $8.4 \times 10^{-6}$ | $6.2 \times 10^{-6}$ | $10.2 \times 10^{-6}$ | $9.0 \times 10^{-6}$ | $6.4 \times 10^{-6}$ |
| 107 (Present Invention) | $7.8 \times 10^{-6}$ | $6.6 \times 10^{-6}$ | $4.5 \times 10^{-6}$ | $7.8 \times 10^{-6}$ | $6.9 \times 10^{-6}$ | $4.8 \times 10^{-6}$ |
| 108 (Present Invention) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |
| 109 (Present Invention) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |
| 110 (Present Invention) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |
| 111 (Comparison) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |
| 112 (Present Invention) | $5.6 \times 10^{-6}$ | $4.2 \times 10^{-6}$ | $3.1 \times 10^{-6}$ | $5.6 \times 10^{-6}$ | $4.5 \times 10^{-6}$ | $3.2 \times 10^{-6}$ |

| Sample No. | Gold/Silver Ratio 11th Layer | 12th Layer | 13th Layer | Total Gold/ Total Silver Ratio | Emulsion Used in 5th, 9th and 13th Layers |
|---|---|---|---|---|---|
| 101 (Comparison) | $16 \times 10^{-6}$ | $14 \times 10^{-6}$ | $10 \times 10^{-6}$ | $12.4 \times 10^{-6}$ | EM-4 |
| 102 (Comparison) | $16 \times 10^{-6}$ | $14 \times 10^{-6}$ | $10 \times 10^{-6}$ | $12.4 \times 10^{-6}$ | EM-1 |
| 103 (Comparison) | $10.2 \times 10^{-6}$ | $8.4 \times 10^{-6}$ | $5.4 \times 10^{-6}$ | $7.3 \times 10^{-6}$ | EM-4 |
| 104 (Comparison) | $7.8 \times 10^{-6}$ | $6.6 \times 10^{-6}$ | $3.6 \times 10^{-6}$ | $5.4 \times 10^{-6}$ | EM-4 |
| 105 (Comparison) | $5.6 \times 10^{-6}$ | $4.2 \times 10^{-6}$ | $2.7 \times 10^{-6}$ | $3.6 \times 10^{-6}$ | EM-4 |
| 106 (Present Invention) | $10.2 \times 10^{-6}$ | $8.4 \times 10^{-6}$ | $5.4 \times 10^{-6}$ | $7.3 \times 10^{-6}$ | EM-1 |
| 107 (Present Invention) | $7.8 \times 10^{-6}$ | $6.6 \times 10^{-6}$ | $3.6 \times 10^{-6}$ | $5.4 \times 10^{-6}$ | EM-1 |
| 108 (Present Invention) | $5.6 \times 10^{-6}$ | $4.2 \times 10^{-6}$ | $2.7 \times 10^{-6}$ | $3.6 \times 10^{-6}$ | EM-1 |
| 109 (Present Invention) | $5.6 \times 10^{-6}$ | $4.2 \times 10^{-6}$ | $2.7 \times 10^{-6}$ | $3.6 \times 10^{-6}$ | EM-2 |
| 110 (Present Invention) | $5.6 \times 10^{-6}$ | $4.2 \times 10^{-6}$ | $2.7 \times 10^{-6}$ | $3.6 \times 10^{-6}$ | EM-3 |
| 111 (Comparison) | $5.6 \times 10^{-6}$ | $4.2 \times 10^{-6}$ | $2.7 \times 10^{-6}$ | $3.6 \times 10^{-6}$ | EM-5 |
| 112 (Present Invention) | $5.6 \times 10^{-6}$ | $4.2 \times 10^{-6}$ | $2.7 \times 10^{-6}$ | $3.6 \times 10^{-6}$ | EM-6 |

The amount of gold to be incorporated was changed in the following manner. An ion exchange resin (for example, Dowex 1×8 manufactured by Dow Chemical) was added to the silver halide emulsion as used in Samples 101 and 102 which had been subjected to gold-/sulfur sensitization and maintained at a temperature of 40° C. in an amount of 4.5 g per 500 g thereof. The mixture was then stirred for 5 to 30 minutes to adjust the amount of gold incorporated. The emulsion was then filtered to remove the ion exchange resin from the silver halide emulsion. The pH value and the pAg value of the emulsion were then adjusted to their original values.

Samples 109 to 112

Samples 109 to 112 were prepared in the same manner as described for Sample 108 except that EM-2, EM-3, EM-5 and EM-6 were employed in place of EM-1 used in the fifth layer, the ninth layer and the thirteenth layer of Sample 108, respectively.

Samples 101 to 112 thus-prepared were stored under conditions of a temperature of 40° C. and a relative humidity of 70% for 14 hours (fresh samples). These samples were subjected to exposure to light for 1/100 second through an optical wedge and then color development processing at 38° C. according to the following processing steps.

| Processing Step | Time |
|---|---|
| Color Development | 3 min. 15 sec. |
| Bleaching | 6 min. 30 sec. |
| Washing with Water | 2 min. 10 sec. |
| Fixing | 4 min. 20 sec. |
| Washing with Water | 3 min. 15 sec. |
| Stabilizing | 1 min. 05 sec. |

The composition of the processing solution used in each step is given below.

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| Bleaching Solution: | |
| Iron (III) ammonium ethylenediamine tetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing Solution: | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 liter |
| pH | 6.6 |
| Stabilizing Solution: | |
| Formalin (40%) | 2.0 ml |
| Polyoxyethylene-p-monononylphenylether (average degree of polymerization: 10) | 0.3 g |
| Water to make | 1.0 liter |

With the samples thus-processed, density measurement was conducted using a blue filter, a green filter and a red filter of status M.

The sensitivity is indicated by the reciprocal of the exposure amount required for obtaining a density of fog+0.15, and the sensitivity of fresh Sample 101 is taken as 100 and the others are shown relatively.

The specific sensitivity of fresh Sample 101 was 500.

Samples 101 to 112 were stored at room temperature at the Ashigara Laboratory of Fuji Photo Film Co., Ltd. in Minami Ashigara-shi, Kanagawa Prefecture, Japan, for one year and then subjected to sensitometry in the manner as described above. The results thus-obtained are shown in Table 4 below.

TABLE 4

| Sample No. | Emulsion Used in 5th, 9th and 13th Layers | Total Gold/ Total Silver Ratio ($\times 10^{-6}$) | Properties of Fresh Sample (just after preparation) | | | | | |
|---|---|---|---|---|---|---|---|---|
| | | | Red-Sensitive Layer | | Green-Sensitive Layer | | Blue-Sensitive Layer | |
| | | | Fog | Relative Sensitivity | Fog | Relative Sensitivity | Fog | Relative Sensitivity |
| 101 (Comparison) | EM-4 | 12.4 | 0.17 | 100 | 0.16 | 100 | 0.18 | 100 |
| 102 (Comparison) | EM-1 | 12.4 | 0.17 | 102 | 0.16 | 102 | 0.18 | 102 |
| 103 (Comparison) | EM-4 | 7.3 | 0.18 | 102 | 0.17 | 100 | 0.18 | 100 |
| 104 (Comparison) | EM-4 | 5.4 | 0.18 | 100 | 0.17 | 102 | 0.19 | 100 |
| 105 (Comparison) | EM-4 | 3.6 | 0.19 | 98 | 0.18 | 100 | 0.19 | 100 |
| 106 (Present Invention) | EM-1 | 7.3 | 0.17 | 102 | 0.16 | 102 | 0.18 | 102 |
| 107 (Present Invention) | EM-1 | 5.4 | 0.18 | 105 | 0.17 | 100 | 0.19 | 102 |
| 108 (Present Invention) | EM-1 | 3.6 | 0.18 | 102 | 0.17 | 100 | 0.18 | 100 |
| 109 (Present Invention) | EM-2 | 3.6 | 0.18 | 100 | 0.17 | 100 | 0.18 | 100 |
| 110 (Present Invention) | EM-3 | 3.6 | 0.19 | 100 | 0.18 | 100 | 0.18 | 100 |
| 111 (Comparison) | EM-5 | 3.6 | 0.19 | 100 | 0.18 | 100 | 0.19 | 95 |
| 112 (Present Invention) | EM-6 | 3.6 | 0.18 | 100 | 0.17 | 102 | 0.18 | 100 |

| | Properties of Sample Stored for 1 Year at Room Temperature | | |
|---|---|---|---|
| | Red-Sensitive | Green-Sensitive | Blue-Sensitive |

TABLE 4-continued

| Sample No. | Layer Fog | Layer Relative Sensitivity | Layer Fog | Layer Relative Sensitivity | Layer Fog | Layer Relative Sensitivity |
|---|---|---|---|---|---|---|
| 101 (Comparison) | 0.27 | 81 | 0.26 | 79 | 0.30 | 75 |
| 102 (Comparison) | 0.23 | 91 | 0.24 | 83 | 0.26 | 83 |
| 103 (Comparison) | 0.27 | 81 | 0.26 | 81 | 0.29 | 81 |
| 104 (Comparison) | 0.26 | 91 | 0.25 | 83 | 0.27 | 81 |
| 105 (Comparison) | 0.24 | 91 | 0.24 | 91 | 0.25 | 89 |
| 106 (Present Invention) | 0.22 | 95 | 0.22 | 93 | 0.22 | 95 |
| 107 (Present Invention) | 0.22 | 95 | 0.20 | 98 | 0.22 | 98 |
| 108 (Present Invention) | 0.21 | 98 | 0.19 | 98 | 0.21 | 98 |
| 109 (Present Invention) | 0.21 | 98 | 0.19 | 98 | 0.22 | 95 |
| 110 (Present Invention) | 0.22 | 95 | 0.21 | 95 | 0.23 | 95 |
| 111 (Comparison) | 0.25 | 91 | 0.25 | 89 | 0.26 | 89 |
| 112 (Present Invention) | 0.21 | 98 | 0.20 | 98 | 0.21 | 98 |

As is apparent from the results shown in Table 4, Samples 106 to 110 and 112 according to the present invention exhibit high sensitivity just after preparation and excellent preservability, that is, less increase in fog and less decrease in sensitivity after storage at room temperature for one year. On the other hand, Samples 101 to 105 and 111 for comparison exhibit almost same sensitivities as those of the samples according to the present invention just after preparation, but both show an increase in fog and a decrease in sensitivity which are large as compared with the samples according to the present invention after storage at room temperature for one year.

Further, the graininess of the samples stored at room temperature for one year and then processed were compared by the eye. As a result, it was recognized that the graininess of Samples 101 to 105 and 111 for comparison was remarkably degradated in comparison with Samples 106 to 110 and 112 according to the present invention. Such a difference of graininess after preservation is mainly derived from a tendency to form fog due to natural radiation.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer containing at least one emulsion in which chemically sensitized silver halide grains composed of tabular silver halide grains having a diameter of a circle corresponding to the projected area of at least 0.4 μm and an average aspect ratio of at least 2 are present in a ratio of at least 50% based on the total projected area of all silver halide grains in the emulsion layer, the tabular silver halide grains having a stratified structure containing at least one layer distinguished from each other with planes substantially parallel to the two main planes facing each other thereof, an average iodine content of the outermost layer in said stratified structure being higher than an average iodine content of the whole silver halide grain by at least 1 mol %, said silver halide containing gold and silver such that the weight ratio (gold/silver) of the amount of gold coated per unit area to the amount of silver coated per unit area of the photographic material is not more than $8.0\times10^{-6}$.

2. A silver halide photographic material as claimed in claim 1, wherein the tabular silver halide grains are subjected to chemical sensitization with a sulfur sensitizing agent and a gold sensitizing agent in combination.

3. A silver halide photographic material as claimed in claim 1, wherein the weight ratio of the amount of gold to the amount of silver is in the range of from $2\times10^{-8}$ to $6\times10^{-6}$.

4. A silver halide photographic material as claimed in claim 1, wherein the silver halide photographic material comprises a red-sensitive silver halide emulsion layer, a green-sensitive silver halide emulsion layer and a blue-sensitive silver halide emulsion layer.

5. A silver halide photographic material as claimed in claim 4, wherein the red-sensitive, green-sensitive and blue-sensitive silver halide emulsion layers each consists of two or more light-sensitive layers having different sensitivities.

6. A silver halide photographic material as claimed in claim 1, wherein 70% or more of the total amount of gold is present in the silver halide grain phase.

7. A silver halide photographic material as claimed in claim 1, wherein the silver halide emulsion comprises a dispersion medium and silver halide selected from silver iodobromide, silver chloroiodobromide and silver chloroiodide.

8. A silver halide photographic material as claimed in claim 1, wherein the tabular silver halide grains are composed of an inner layer containing silver iodobromide and an outer layer containing silver iodobromide on each side of the two main planes of the inner layer, with the outer layer containing from 1 to 50 mol % of silver based on the total silver content per grain.

9. A silver halide photographic material as claimed in claim 1, wherein the tabular silver halide grain is composed of an inner layer containing silver chloroiodobromide and an outer layer containing silver (chloro)iodobromide on each side of the two main planes of the inner layer, with the outer layer containing from 1 to 50 mol % of silver based on the total silver content per grain.

10. A silver halide photographic material as claimed in claim 1, wherein the tabular silver halide grain is composed of an inner layer containing silver bromide and an outer layer containing silver iodobromide on each side of the two main planes of the inner layer, with the outer layer containing from 1 to 50 mol % of silver based on the total silver content per grain.

11. A silver halide photographic material as claimed in claim 1, wherein the average iodine content of the outer layer is in a range of from 1 to 40 mol %.

12. A silver halide photographic material as claimed in claim 1, wherein the silver halide emulsion is a monodispersed emulsion in which 90% (by weight or number) of the total silver halide grains have grain sizes within ±40% of the average grain size.

13. A silver halide photographic material as claimed in claim 1, wherein the silver halide photographic material has a silver content of from 3.0 to 13.0 g/m$^2$.

14. A silver halide photographic material as claimed in claim 5, wherein the silver content in the respective emulsion layer having the highest sensitivity in the red-sensitive layer, the green sensitive layer and the blue-sensitive layer is in the range of from 0.3 to 2.5 g/m$^2$.

15. A silver halide photographic material as claimed in claim 5, wherein at least one respective emulsion layer in the red-sensitive layer, the green-sensitive layer and the blue-sensitive layer contains a cyan coupler, a magenta coupler and a yellow coupler respectively.

16. A silver halide photographic material as claimed in claim 1, wherein said diameter of a circle corresponding to the projected area is from 0.6 μm to 20 μm.

17. A silver halide photographic material as claimed in claim 1, wherein said diameter of a circle corresponding to the projected area is from 0.8 μm to 10 μm.

18. A silver halide photographic material as claimed in claim 1, wherein said average aspect ratio is from 2.5 to 50.

19. A silver halide photographic material as claimed in claim 1, wherein said average aspect ratio is from 3 to 30.

20. A silver halide photographic material as claimed in claim 1, wherein said average aspect ratio is from 4 to 20.

21. A silver halide photographic material as claimed in claim 1, wherein said ratio based on the total projected area is at least 60%.

22. A silver halide photographic material as claimed in claim 1, wherein said ratio based on the total projected area is at least 70%.

* * * * *